US008119317B2

(12) United States Patent
Kami et al.

(10) Patent No.: US 8,119,317 B2
(45) Date of Patent: Feb. 21, 2012

(54) ELECTROPHOTOGRAPHIC PHOTORECEPTOR, AND PROCESS CARTRIDGE AND IMAGE FORMING APPARATUS USING THE PHOTORECEPTOR

(75) Inventors: Hidetoshi Kami, Numazu (JP); Tetsuro Suzuki, Fuji (JP); Hiroshi Tamura, Susono (JP); Hiroshi Ikuno, Yokohama (JP); Yukio Fujiwara, Numazu (JP); Takafumi Iwamoto, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 716 days.

(21) Appl. No.: 12/133,089

(22) Filed: Jun. 4, 2008

(65) Prior Publication Data

US 2008/0311499 A1 Dec. 18, 2008

(30) Foreign Application Priority Data

Jun. 13, 2007 (JP) ..... 2007-156188

(51) Int. Cl.
*G03G 5/14* (2006.01)

(52) U.S. Cl. ..... 430/66; 430/132; 399/159

(58) Field of Classification Search ..... 430/66, 430/67, 132; 399/159
See application file for complete search history.

(56) References Cited

U.S. PATENT DOCUMENTS

| | | | |
|---|---|---|---|
| 5,322,753 | A | 6/1994 | Tamura et al. |
| 5,488,137 | A | 1/1996 | Tamura et al. |
| 5,492,784 | A | 2/1996 | Yoshikawa et al. |
| 5,608,010 | A | 3/1997 | Tamura et al. |
| 5,871,876 | A | 2/1999 | Ikuno et al. |
| 6,030,733 | A | 2/2000 | Kami et al. |
| 6,066,428 | A | 5/2000 | Katayama et al. |
| 6,151,468 | A | 11/2000 | Kami et al. |
| 6,194,535 | B1 | 2/2001 | Katayama et al. |
| 6,210,848 | B1 | 4/2001 | Nagai et al. |
| 6,432,596 | B2 | 8/2002 | Ikuno et al. |
| 6,686,114 | B2 | 2/2004 | Sakon et al. |
| 6,861,188 | B2 | 3/2005 | Ikegami et al. |
| 6,998,209 | B2 | 2/2006 | Ikuno et al. |
| 7,175,957 | B2 | 2/2007 | Suzuki et al. |
| 7,179,573 | B2 | 2/2007 | Suzuki et al. |
| 7,189,487 | B2 | 3/2007 | Ikuno et al. |
| 7,251,437 | B2 | 7/2007 | Tamoto et al. |
| 7,267,916 | B2 | 9/2007 | Sugino et al. |
| 7,279,260 | B2 | 10/2007 | Nagai et al. |
| 7,314,693 | B2 | 1/2008 | Ikegami et al. |
| 7,315,722 | B2 | 1/2008 | Kitajima et al. |
| 7,341,814 | B2 | 3/2008 | Kami et al. |
| 7,348,113 | B2 | 3/2008 | Shoshi et al. |
| 2005/0008957 | A1 | 1/2005 | Ikegami et al. |
| 2005/0158641 | A1 | 7/2005 | Yanagawa et al. |
| 2005/0158644 | A1 | 7/2005 | Kondo et al. |
| 2005/0175911 | A1 | 8/2005 | Tamoto et al. |
| 2005/0221210 | A1 | 10/2005 | Suzuki et al. |
| 2005/0238987 | A1 | 10/2005 | Ohshima et al. |
| 2005/0266325 | A1 | 12/2005 | Yanagawa et al. |
| 2005/0266328 | A1 | 12/2005 | Yanagawa et al. |
| 2005/0282075 | A1 | 12/2005 | Ikuno et al. |
| 2005/0287452 | A1 | 12/2005 | Tamura et al. |
| 2005/0287465 | A1 | 12/2005 | Ohshima et al. |
| 2006/0014093 | A1 | 1/2006 | Li et al. |
| 2006/0014096 | A1 | 1/2006 | Ohshima et al. |
| 2006/0051689 | A1 | 3/2006 | Suzuki et al. |
| 2006/0068308 | A1 | 3/2006 | Ohshima et al. |
| 2006/0093955 | A1 | 5/2006 | Ohshima et al. |
| 2006/0110668 | A1 | 5/2006 | Kawasaki et al. |
| 2006/0160003 | A1 | 7/2006 | Nagai et al. |
| 2006/0177749 | A1 | 8/2006 | Tamoto et al. |
| 2007/0009818 | A1 | 1/2007 | Yanagawa et al. |
| 2007/0031746 | A1 | 2/2007 | Toshine et al. |
| 2007/0122724 | A1 | 5/2007 | Suzuki et al. |
| 2007/0154825 | A1 | 7/2007 | Tamoto et al. |
| 2007/0196749 | A1 | 8/2007 | Inaba et al. |
| 2007/0196750 | A1 | 8/2007 | Fujiwara et al. |
| 2007/0212625 | A1 | 9/2007 | Suzuki et al. |
| 2007/0212626 | A1 | 9/2007 | Toshine et al. |
| 2007/0212627 | A1 | 9/2007 | Yanagawa et al. |
| 2007/0231720 | A1 | 10/2007 | Mori et al. |
| 2007/0269729 | A1 | 11/2007 | Ikuno et al. |
| 2007/0292780 | A1 | 12/2007 | Nagai et al. |
| 2008/0020305 | A1 | 1/2008 | Suzuki et al. |
| 2008/0085459 | A1 | 4/2008 | Kami et al. |

FOREIGN PATENT DOCUMENTS

| | | |
|---|---|---|
| JP | 7-325409 | 12/1995 |
| JP | 2000-66424 | 3/2000 |
| JP | 2000-171990 | 6/2000 |
| JP | 2002-258499 | 9/2002 |
| JP | 2002-318467 | 10/2002 |
| JP | 3442255 | 6/2003 |
| JP | 2006-291188 | 10/2006 |
| JP | 2007-248914 | * 9/2007 |
| JP | 4056063 | 12/2007 |

OTHER PUBLICATIONS

Japanese Patent Office machine-assisted translation of JP 2007-248914 (pub. Sep. 2007).*
Diamond, A.S., ed., Handbook of Imaging Materials, Marcel Dekker, Inc., NY (1991), pp. 395-396.*
Diamond, A.S., et al., ed., Handbook of Imaging Materials, Second Edition, Marcel Dekker, Inc., NY (2002), pp. 146-148.*

* cited by examiner

*Primary Examiner* — Janis L Dote
(74) *Attorney, Agent, or Firm* — Cooper & Dunham LLP

(57) ABSTRACT

An electrophotographic photoreceptor, including an electroconductive substrate; a photosensitive layer, located overlying the electroconductive substrate; and a crosslinked resin surface layer, located overlying the photo sensitive layer, wherein the crosslinked resin surface layer includes a crosslinked body of trimethylolpropanetriacrylate, isocyanate including a radical polymerizable functional group and a heat or a light-curable charge transport material.

7 Claims, 5 Drawing Sheets

ELECTROPHOTOGRAPHIC PHOTORECEPTOR, AND PROCESS CARTRIDGE AND IMAGE FORMING APPARATUS USING THE PHOTORECEPTOR

BACKGROUND OF THE INVENTION

BACKGROUND

1. Technical Field

This disclosure relates to an electrophotographic photoreceptor, and to a process cartridge and an image forming apparatus using the photoreceptor, which are applied to copiers, facsimiles, laser printers, direct digital platemakers, etc.

2. Discussion of the Related Art

Photoreceptors including inorganic materials such as selenium, zinc oxide, cadmium sulfide used to be mainly used as electrophotographic photoreceptors used in electrophotographic image forming apparatuses such as copiers and laser printers. However, at present, almost all the electrophotographic photoreceptors are organic photoreceptors which are advantageous more than the inorganic photoreceptors in terms of load reduction for the global environment, cost reduction and layout freedom.

Further, as importance of production in consideration of the global environment protection increases, the organic photoreceptor is required to change from a consumable to a machine component.

In order to make the organic photoreceptors more durable, Japan Hardcopy '97 Fall Meeting, 25-28, 1997 written by Hiroyuki Tamura, Saeko Takahashi, Hironobu Morishita, Hideji Sakamoto and Haruo Shiguma discloses changing a binder resin; Japanese published unexamined application No. 7-325409 discloses polymerizing a charge transport material; Japanese published unexamined application No. 2002-258499 discloses forming a cured protection layer including a high hardness filler; Japanese published unexamined application No. 2000-66424 discloses forming a crosslinked resin surface layer; and Japanese published unexamined application No. 2000-171990 discloses forming a sol-gel cured layer on the surface of a photoreceptor. These methods have an advantage and a disadvantage, respectively. Particularly, the latter two methods are thought reasonable because of forming a crosslinked layer with plural chemical bonds, which is not quickly abraded even when the chemical bonds are partly cut with a stress. Hereinafter, the layers are referred to as "crosslinked surface layers".

The organic photoreceptor having quite high abrasion resistance needs damage resistance as well. This is because discharge hazards concentrate on a damage on the surface of the photoreceptor, resulting deterioration thereof. In addition, a developer including a toner, and a paper powder are likely to bury in a damage, resulting in local defective images such as background fouling and blurred images. The damage on a photoreceptor having too high abrasion resistance is difficult to remove as time passes, which prevents the photoreceptor from having a longer life.

Recently, polymerized toners are mostly used in full-color electrophotographic apparatuses in terms of image quality and high environmental performance. The polymerized toner having higher sphericity improves image sharpness more. However, such toners are likely to scrape through a cleaning blade collecting a toner remaining on a photoreceptor, resulting in stripe image noises. Japanese published unexamined application No. 2002-318467 discloses including a silica powder in the toner to hold the toner between a blade and a photoreceptor. However, the silica often causes a damage on the surface of a photoreceptor or sticks into the surface thereof and becomes deposited thereon. Consequently, the photoreceptor having higher abrasion resistance does not always have a longer life.

The crosslinked surface layer includes an acrylic crosslinked layer and a silicon hard-coated layer which are particularly advantageous to improving the abrasion resistance. However, such photoreceptors have the above-mentioned damage problems in electrophotographic apparatuses using polymerized toners.

As a means of preventing a damage on the surface of a photoreceptor and filming over the surface thereof with silica, the irradiation energy for forming the cured surface layer is advantageously strengthened. However, particularly materials at the surface of a photoreceptor deteriorate when the irradiation energy is strengthened, resulting in increase of irradiated part potential and deterioration of the resultant printed image quality.

Because of these reasons, a need exists for an electrophotographic photoreceptor having good abrasion resistance and preventing the surface thereof from being damaged and filmed with silica.

BRIEF SUMMARY

It was hypothesized that the material deterioration when forming the crosslinked surface layer with a strong irradiation energy could be reduced with a heat-curable resin, and namely, that the material degradation could be reduced if the irradiation energy is used for a heat for curing the crosslinked surface layer. However, the surface layer occasionally has uneven hardness after a heat-curable resin is blended with a radical polymerizable crosslinked resin. The radical polymerizable crosslinked resin and heat-curable resin are thought to reject each other when they have low affinity. It was discovered through substantial investigation that adding a compound having a functional group bonding the heat-curable resin with the radical polymerizable resin can solve the problem.

In an aspect of this disclosure, there is provided an electrophotographic photoreceptor producing high-quality images, having good abrasion resistance and preventing the surface thereof from being damaged and filmed with silica.

In another aspect, there is provided a process cartridge using the electrophotographic photoreceptor.

In another aspect, there is provided an image forming apparatus using the electrophotographic photoreceptor.

In another aspect of this disclosure, there is provided an electrophotographic photoreceptor, comprising:

an electroconductive substrate;

a photosensitive layer, located overlying the electroconductive substrate; and a crosslinked resin surface layer, located overlying the photosensitive layer, wherein the crosslinked resin surface layer comprises a cross linked body of trimethylolpropanetriacrylate, isocyanate including a radical polymerizable functional group and a heat or a light-curable charge transport material.

The aforementioned and other aspects, features and advantages will become apparent upon consideration of the following description of the preferred embodiments taken in conjunction with the accompanying drawings.

DESCRIPTION OF THE PREFERRED EMBODIMENTS

Figure 1:
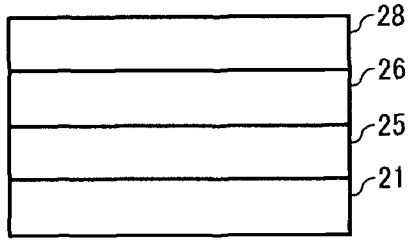
FIG. 1 is a schematic view illustrating a sectional view of a layer constitution of the electrophotographic photoreceptor of the present invention.

Generally, the present invention provides an electrophotographic photoreceptor producing high-quality images, having good abrasion resistance and preventing the surface thereof from being damaged and filmed with silica.

More particularly, the present invention relates to an electrophotographic photoreceptor, comprising:

an electroconductive substrate;

a photosensitive layer, located overlying the electroconductive substrate; and a crosslinked resin surface layer, located overlying the photosensitive layer, wherein the crosslinked resin surface layer comprises a crosslinked body of trimethylolpropanetriacrylate, isocyanate including a radical polymerizable functional group and a heat or a light-curable charge transport material.

The crosslinked resin surface layer of the present invention includes a crosslinked body of trimethylolpropanetriacrylate (TMPTA), isocyanate including a radical polymerizable functional group, and a thermosetting or light-curing charge transport material. An acrylic resin including TMPTA as a main component has high hardness. The mechanical strength of the crosslinked resin surface layer mostly depends on a crosslink density of materials forming the layer. TMPTA is advantageously used for forming a layer having high crosslink density. The isocyanate including a radical polymerizable functional group forms a urea bond with each other in an acrylic crosslinked layer when included therein. Polyol compounds or active hydrogen compounds form a urethane bond when included therein. According to the present invention, an acrylic crosslinked layer including isocyanate can chemically bond various flexible polyols such as thermosetting dimethylpolysiloxane, organosilane, fluoreresins, charge transport materials and polycaprolactone. Bonding various materials can reduce a friction coefficient of the crosslinked resin surface layer, increase and decrease a hardness thereof or improve charge transportability thereof.

The isocyanate including a radical polymerizable functional group includes 2-methacryloyloxyethylisocyanate, 2-acryloyloxyethylisocyanate and 1,1-bis(acryloyloxymethyl)ethylisocyanate. These do not deteriorate the electrostatic properties or hardness of the crosslinked resin surface layer, and are marketed from Showa Denko K.K. as a brand name of KARENZ.

A charge transport material is preferably included in the crosslinked resin surface layer because of preventing a residual image from appearing and an irradiated part potential from decreasing. Particularly, a heat or a light-curable charge transport material having a crosslinkable substituent to form a tough layer. A compound having a radical polymerizable functional group and the following formula (1) is preferably used as the heat or light-curable charge transport material:

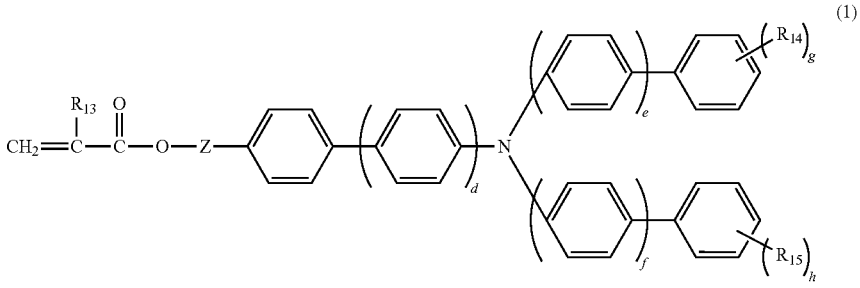

(1)

wherein d, e and f independently represent 0 or 1; $R_{13}$ represents a hydrogen atom or a methyl group; $R_{14}$ and $R_{15}$ independently represent an alkyl group having 1 to 6 carbon atoms; g and h independently represent 0 or an integer of from 1 to 3; and Z represents a single bond, a methylene group, an ethylene group,

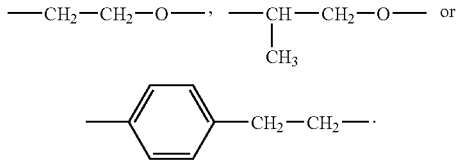

When a heat-curable charge transport material includes an active hydrogen having a small substance quantity (equivalent), which assumes curable, in its molecular frame, the content of a curing agent in the layer increases, resulting in limitation of a maximum content of the curable charge transport material.

The equivalent is preferably 200 or more. Particularly, compounds having the following formulae (2) and (4) are preferably used:

(2)

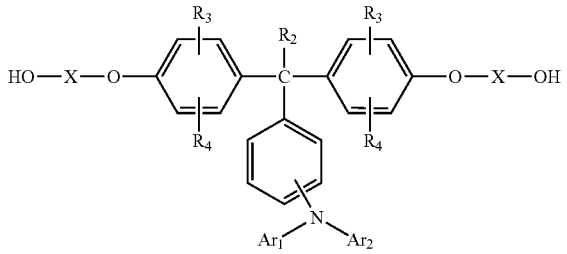

wherein $R_2$, $R_3$ and $R_4$ independently represent a hydrogen atom, a substituted or an unsubstituted alkyl group or an aryl group; $Ar_1$ and $Ar_2$ represent an aryl group; and X represents any one of the following (a) to (c):

(a) an alkylene group;

(b) an arylene group;

(c) a group having the following formula (3); and (3)

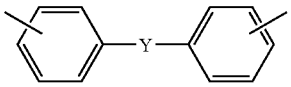

wherein Y represents —O—, —S—, —SO—, —$SO_2$—, —CO—,

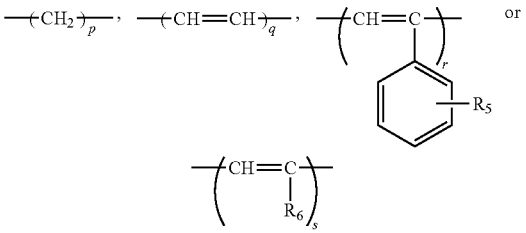

wherein $R_5$ and $R_6$ independently represent a hydrogen atom, an alkyl group, an alkoxy group, a halogen atom, an aryl group, an amino group, a nitro group or a cyano group; and p, q, r and s independently represent an integer of from 1 to 12, and (4)

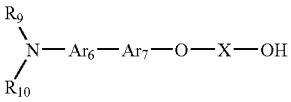

wherein $R_9$ and $R_{10}$ independently represent a substituted or an unsubstituted aryl group; $Ar_6$ and $Ar_7$ represent an arylene group, e.g., independently represent a bivalent group of the same aryl group as that of $R_9$ and $R_{10}$; and X is the same as those of the compound having the formula (2).

In the present invention, polyol having a polycaprolactone framework is preferably bonded with isocyanate, which is a cushion against a kinetic load in the crosslinked layer and protects the layer from being damaged. Crosslinked polyol and polyisocyanate partly has self-curability. The self-curability is a capability of mending and extinguishing slight damages or dents with age owing to the elasticity of a layer. A self-curing coating material includes a functional group having a side chain longer than that of a functional group of a typical resin coating material. This proves that molecular frameworks forming a resin has high kinetic variance of cross linked parts between main chains. Therefore, the long side chain works as a spring against an external stress, which realize the self-curability with elasticity. Self-curing CLEAR coating from Natoco Co., Ltd. has very high self-curability, but the photoreceptor of the present invention does not need such a coating, i.e., may substantially be protected from being damaged. This is why the polyol having a polycaprolactone framework is preferably selected, which is a cushion against a kinetic load in the crosslinked layer and protects the layer from being damaged.

Specific examples of the polycaprolactone framework include bifunctional polycaprolactone diols having the following formula (5):

(5)

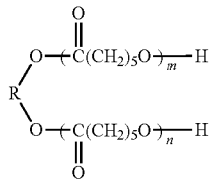

wherein m+n is an integer of from 4 to 35; and R represents $C_2H_4$, $C_2H_4OC_2H_4$ or $C(CH_3)_2(CH_2)_2$, trifunctional polycaprolactone triols having the following formula (6):

(6)

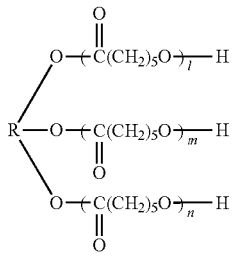

wherein l+m+n is an integer of from 3 to 30; and R represents $CH_2CHCH_2$, $CH_3C(CH_2)_3$, and $CH_3CH_2C(CH_2)_3$, and tetrafunctional polycaprolactone polyols.

Number of grades of the polycaprolactone polyols are marketed from Daicel Chemical Industries, Ltd. as a brand name of Praccell. As polyols having good self-curability, in addition to the above polycaprolactone polyols, polyester polyols BURNOCK, DS-1600, DS-1000 and DS-1300 marketed from DIC Corporation; and Self-curing CLEAR from Natoco Co., Ltd. are preferably used.

The radical polymerizable cured layer generates a high radiation heat. An excessive energy damages an underlying photosensitive layer. The irradiated part potential of a damaged photoreceptor often increases. Therefore, a substrate of a photoreceptor needs to be water-cooled, or air-cooled and intermittently-irradiated to reduce the damage when forming a layer. In the present invention, the radiation heat generating when forming a cured layer with irradiation is absorbed by a crosslinking reaction at an isocyanate site, which reduces damages with the radiation heat to the photosensitive layer. The above-mentioned control is preferably added in the process of forming a layer, however, the present invention largely improves yield of forming layers.

Japanese published unexamined application No. 2006-010963 discloses a met-hod of forming a crosslinked resin layer on the surface of an electrophotographic photoreceptor with a combination of heat and light curing. As disclosed in [0025], a photopolymerization initiator and a thermopolymerization initiator enhance the uniformity of a crosslinked resin surface layer, prevent a oxidizing gas from being absorbed to an unreacted carbon-carbon double bonded site, and prevent wrinkles and cracks from generating. This is different from the present invention in the object and constitution, however, effects thereof are partially achieved by the present invention.

The electrophotographic photoreceptor is scarcely damaged even after producing images for long periods or a large number of images. An image forming apparatus using the photoreceptor is highly practicable because of being capable of producing images with a polymerized toner for long periods.

Hereinafter, the electrophotographic photoreceptor of the present invention will be explained in detail, referring to the drawings.

FIG. 1 is a cross-sectional view of an embodiment of layers of the electrophotographic photoreceptor of the present invention, wherein a charge generation layer (CGL) 25, a charge transport layer (CTL) 26 and a crosslinked resin surface layer 28 are formed on an electroconductive substrate 21.

Figure 2:
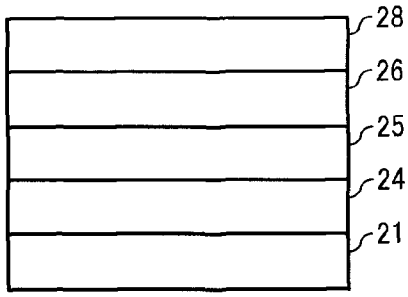
FIG. 2 is a schematic view illustrating a sectional view of another layer constitution of the electrophotographic photoreceptor of the present invention.

FIG. 2 is a cross-sectional view of another embodiment of layers of the electrophotographic photoreceptor of the present invention, wherein an undercoat layer 24 is formed between an electroconductive substrate 21 and a CGL 25, and a CTL 26 and a crosslinked resin surface layer 28 are formed on the CGL 25.

Suitable materials as the electroconductive substrate 21 include materials having a volume resistance not greater than $10^{10}\Omega\cdot$cm. Specific examples of such materials include plastic cylinders, plastic films or paper sheets, on the surface of which a metal such as aluminum, nickel, chromium, nichrome, copper, gold, silver and platinum, or a metal oxide such as tin oxides and indium oxides, is deposited or sputtered. In addition, a plate of a metal such as aluminum, aluminum alloys, nickel and stainless steel and a metal cylinder, which is prepared by tubing a metal such as the metals mentioned above by a method such as drawing ironing, impact ironing, extruded ironing and extruded drawing, and then treating the surface of the tube by cutting, super finishing, polishing and the like treatments, can also be used as the substrate.

In the photoreceptor of the present invention, an undercoat layer 24 can be formed between the substrate and a photosensitive layer to improve adhesion between the substrate and the photosensitive layer; to prevent formation of moiré; to improve the coating property of the overlying layer; to reduce the residual potential; and to prevent injection of charges from the substrate into the photosensitive layer.

The undercoat layer typically includes a resin as a main component. Since a photosensitive layer is typically formed on the undercoat layer by coating a liquid including an organic solvent, the resin in the undercoat layer is preferably a thermosetting resin difficult to dissolve in organic solvents. Particularly, polyurethane resins, melamine resins and alkyd-melamine resins are preferably used. The resins are dissolved in a solvent such as tetrahydrofuran, cyclohexanone, dioxane, dichloroethane, butanone to prepare a coating liquid.

The undercoat layer may include a particulate metal or a metal oxide to adjust the conductivity and prevent formation of moiré. Particularly, titanium oxide is preferably used.

The particulate metal or metal oxide is dispersed in a solvent such as tetrahydrofuran, cyclohexanone, dioxane, dichloroethane, butanone to prepare a dispersion, and the dispersion is mixed with a resin to prepare a coating liquid.

The undercoat layer can be formed by coating the coating liquid on a substrate by a method such as a dip coating method, a spray coating method and a bead coating method, and optionally by heat curing.

The undercoat layer preferably has a thickness of from 2 to 5 μm, and preferably less than 3 μm when the residual potential of a photoreceptor becomes large.

A multilayered photosensitive layer including a CGL and CTL is preferably used in the present invention.

The CGL 25 in the multilayered photosensitive layer will be explained. The charge generation layer is a part of the multilayered photosensitive layer and generates a charge when irradiated. Among compounds included in this layer, a charge generation material is a main component thereof. A binder resin is optionally used in the charge generation layer. Inorganic materials and organic materials can be used as the charge generation material.

Specific examples of the inorganic materials include crystalline selenium, amorphous selenium, selenium-tellurium alloys, selenium-tellurium-halogen alloys, selenium-arsenic alloys and amorphous silicone. The amorphous silicone prepared by terminating a dangling bond with a hydrogen atom or a halogen atom, or doping a boron atom or a phosphorus atom.

Specific examples of the organic charge generation materials include known materials, for example, phthalocyanine pigments such as metal phthalocyanine and metal-free phthalocyanine, azulenium pigments, squaric acid methine pigments, symmetric or asymmetric azo pigments having a carbazole skeleton, symmetric or asymmetric azo pigments having a triphenylamine skeleton, symmetric or asymmetric azo pigments having a fluorenone skeleton, perylene pigments, etc. Among these materials, the metal phthalocyanine, symmetric or asymmetric azo pigments having a fluorenone skeleton, symmetric or asymmetric azo pigments having a triphenylamine skeleton and perylene pigments are preferably used because they all have high charge generation quantum efficiency. These charge generation materials can be used alone or in combination.

Specific examples of the binder resin optionally used in the CGL include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination.

Suitable methods for forming the CGL are broadly classified into thin film forming methods in a vacuum and casting methods.

Specific examples of the former thin film forming methods in a vacuum include vacuum evaporation methods, glow discharge decomposition methods, ion plating methods, sputtering methods, reaction sputtering methods, CVD (chemical vapor deposition) methods, and the like methods. A layer of the above-mentioned inorganic and organic materials can be formed by one of these methods.

The casting methods for forming the charge generation layer typically include the following steps:

(1) preparing a coating liquid by mixing one or more inorganic or organic charge generation materials mentioned above with a solvent such as tetrahydrofuran, cyclohexanone, dioxane, dichloroethane, butanone and the like, optionally together with a binder resin and an additive, and then dispersing the materials with a ball mill, an attritor, a sand mill or the like, to prepare a CGL coating liquid;

(2) coating the CGL coating liquid, which is diluted if necessary, on a substrate by a method such as dip coating, spray coating, bead coating and ring coating; and (3) drying the coated liquid to form a CGL.

The CGL preferably has a thickness of from about 0.01 to 5 μm.

The CGL preferably has a thinner thickness when the photoreceptor needs reduction of residual potential and higher sensitivity. At the same time, the charge retainability and space charge formation thereof often deteriorate. In order to balance the properties, the CGL more preferably has a thickness of from about 0.05 to 2 μm.

The CGL can optionally include one or more low-molecular-weight compounds such as antioxidants, plasticizers, lubricants and ultraviolet absorbents, and a leveling agent. The CGL preferably includes these in an amount of from 0.1 to 20 phr, more preferably from 0.1 to 10 phr, and the leveling agents in an amount of from 0.001 to 0.1 phr.

The CTL is apart of the multilayered photosensitive layer, which receives a charge generated in the CGL, and transports the charge to a surface of a photoreceptor to neutralize a charge thereof. A main component of the charge transport layer not including a fluorine-containing resin is a charge transport material and a binder resin binding this.

The charge transport materials include low-molecular-weight electron transport materials, positive hole transport materials and polymeric charge transport materials.

Specific examples of the electron transport materials include electron accepting materials such as an asymmetric diphenoquinone derivative, a fluorene derivative and a naphthalimide derivative.

These electron transport materials can be used alone or in combination.

Specific examples of the positive hole transport materials include electron donating materials such as an oxazole derivative, an oxadiazole derivative, an imidazole derivative, a triphenylamine derivative, 9-(p-diethylaminostyrylanthracene), 1,1-bis(4-dibenzylaminophenyl)propane, styrylanthracene, styrylpyrazoline, a phenylhydrazone compound, an α-phenylstilbene derivative, a thiazole derivative, a triazole derivative, a phenazine derivative, an acridine derivative, a benzofuran derivative, a benzimidazole derivative, a thiophene derivative, etc.

These positive hole transport materials can be used alone or in combination.

In addition, the following polymeric charge transport materials can be used. Polymers having a carbazole ring such as poly-N-vinylcarbazole, polymers having a hydrazone structure disclosed in Japanese published unexamined application No. 57-78402, polysilylene compounds disclosed in Japanese Laid-Open Patent Publication No. 63-285552 and aromatic polycarbonates having formulae (1) to (6) disclosed in Japanese published unexamined application No. 2001-330973.

These polymeric charge transport materials can be used alone or in combination. Particularly, the exemplified compounds disclosed in Japanese published unexamined application No. 2001-330973 are effectively used because of having good electrostatic properties.

The polymeric charge transport materials do not exude less from a CTL to a crosslinked resin surface layer than a low-molecular-weight charge transport material, and are suitable materials to prevent the crosslinked resin surface layer from being poorly cured. Further, the polymeric charge transport materials have good heat resistance and is not much affected with a heat curing the crosslinked resin surface layer.

Specific examples of the polymers for use as the binder resin of the CTL include thermoplastic resins and thermosetting resins such as polystyrene, polyester, polyarylate, polycarbonate, acrylic resins, silicone resins, fluorine-containing resins, epoxy resins, melamine resins, urethane resins, phenolic resins and alkyd resins. Particularly, polystyrene, polyester, polyarylate and polycarbonate are preferably used as a binder of a charge transport material because of their good charge transportability. Since a crosslinked resin surface layer is formed on a CTL, the CTL is not required to have a mechanical strength as a conventional CTL. Therefore, a material having high transparency but low mechanical strength such as polystyrene, which used to be difficult to use, can effectively be used as a binder for the CTL.

These polymeric compounds can be used alone or in combination. In addition, copolymers of the monomers of the polymer materials mentioned above can also be used. Further, copolymers of the monomers with a charge transport material can also be used.

When an electrically inactive polymer is used to reform a CTL, caldo polymer-type polyester; polyester such as polyethylenephthalate and polyethylenenaphthalate; polycarbonate formed of bisphenol-type polycarbonate, the phenol 3,3' portion of which is substituted by an alkyl group such as C-type polycarbonate; polycarbonate formed of bisphenol A, the geminal methyl group of which is substituted by a long-chain alkyl group having two or more carbon atoms; polycarbonate having a biphenyl or biphenyl ether skeleton; polycaprolactone; polycarbonate having a long-chain alkyl skeleton such as polycaprolactone disclosed in Japanese published unexamined application No. 7-292095; an acrylic resin; polystyrene and hydrogenated butadiene are effectively used.

The electrically inactive polymer means a polymer which does not have a structure having a photoconductive property, such as the triarylamine structure.

When these resins are used as an additive together with a binder resin, the content thereof is preferably not greater than 50% by weight in view of photosensitivity of the resultant photoreceptor.

When a low molecular weight charge transport material is used, a content thereof is preferably from 40 to 200 phr (parts per hundred of resin), and preferably from 70 to 100 phr. When a charge transport polymer is used, a content thereof is preferably from 0 to 200 parts by weight, and preferably from 80 to 150 parts by weight, per 100 parts by weight of the charge transport components included therein.

When two or more kinds of charge transport materials are included in the CTL, the difference in ionization potential between the two or more kinds of charge transport materials is as small as possible, specifically the difference is preferably not greater than 0.10 eV. In this case, it is prevented that one of the charge transport materials serves as a trap of the other charge transport materials.

In addition, a charge transport material and an after-mentioned curable charge transport material included in a CTL preferably have a difference of 0.10 eV in ionization potential as well.

The ionization potential in the present invention is measured by an atmospheric ultraviolet photoelectron analyzer AC-1 from Riken Keiki Co., Ltd. in a typical method.

To impart high photosensitivity to a photoreceptor, the content of the charge transport materials in the CTL is preferably not less than 70 phr. Suitable the charge transport materials include α-phenylstilbene compounds, benzidine compounds, monomers and dimmers of butadiene compounds and charge transport polymer materials having these structures in their main or side chains because of their high charge transportability.

Suitable solvents for use in the CTL coating liquid include ketone such as methyl ethyl ketone, acetone, methyl isobutyl ketone, and cyclohexanone; ethers such as dioxane, tetrahydrofuran, and ethyl cellosolve; aromatic solvents such as toluene, and xylene; halogen-containing solvents such as chlorobenzene, and dichloromethane; esters such as ethyl acetate and butyl acetate; etc. Particularly, methyl ethyl ketone, tetrahydrofuran and cyclohexanone are more preferably used than chlorobenzene, dichloromethane, toluene and xylene because of their low environmental burdens. These solvents can be used alone or in combination.

The CTL can be formed by dissolving or dispersing a mixture or a copolymer mainly formed of a charge transport material and a binder resin in a solvent to prepare a coating liquid; and coating and drying the coating liquid. Suitable coating methods include a dip coating method, a spray coating method, a ring coating method, a roll coating method, a gravure coating method, a nozzle coating method and a screen printing method.

Since a crosslinked resin surface layer is formed on the CTL, the CTL does not need to have a thickness in consideration of a practical layer abrasion and can be thinner.

The CTL preferably has a thickness of from 15 to 40 μm, and more preferably from 15 to 30 μm to have practically required sensitivity and chargeability.

The CTL can optionally include one or more additives such as antioxidants, plasticizers, lubricants and ultraviolet absorbents, if desired. Specific examples thereof are mentioned below. These additives are added in the CTL in an amount of from 0.1 to 20 phr, preferably from 0.1 to 10 phr. The leveling agents are added in an amount of from 0.001 to 0.1 phr.

The crosslinked resin surface layer is a protection layer formed on a photoreceptor. After a coating liquid is coated, a crosslinked resin layer is formed by a polycondensation reaction. The crosslinked resin surface layer has the highest abrasion resistance in each layer of a photoreceptor because of having a crosslinked structure. In addition, the layer has charge transportability similar to that of the CTL because of including a crosslinkable charge transport material.

It is essential that the crosslinked resin surface layer includes at least a crosslinked body of trimethylolpropanetriacrylate, isocyanate including a radical polymerizable functional group and a heat or a light-curable charge transport material. The crosslinked density of the surface layer needs to be properly large to prevent a damage on the surface of a photoreceptor and filming over the surface thereof with silica. Having three functional groups regardless of its low molecular weight, the trimethylolpropanetriacrylate advantageously increases the crosslinked density. Acrylic functional groups are preferably included in the surface layer in an amount not less than 3 mmol per 1 g of total weight of solid contents therein. It is preferable that the content of the trimethylolpropanetriacrylate is approximately from 20 to 60% by weight to satisfy this condition, although depending on a combined material. The maximum is to prevent a charge transport material from decreasing to cause deterioration of sensitivity, and is subject to change depending on the electrophotographic process.

As a tri- or more functional binder component, caprolactone-modified dipentaerythlitolhexaacrylate or dipentaerythlitolhexaacrylate is preferably include, which often improves the abrasion resistance and toughness of the crosslinked layer. This is because the crosslinked resin surface layer is thought to increase an elastic power. As a tri- or more functional radical polymerizable monomer, trimethylolpropanetriacrylate, caprolactone-modified dipentaerythlitolhexaacrylate and dipentaerythlitolhexaacrylate are preferably used. These are available from reagent manufacturers such as Tokyo Chemical Industry Co., Ltd. and Nippon Kayaku Co., Ltd. marketing KAYARD DPCA series and DPHA series. In addition to this, a starter such as IRGACURE 184 from Ciba Speciality Chemicals may be added to the crosslinked resin surface layer in an amount of from 5 to 10% by weight based on total weight of solid contents therein.

The isocyanate including a radical polymerizable functional group includes 2-methacryloyloxyethylisocyanate, 2-acryloyloxyethylisocyanate and 1,1-bis(acryloyloxymethyl)ethylisocyanate. These do not deteriorate the electrostatic properties of the crosslinked resin surface layer and do not cause poor curable thereof. These are marketed from Showa Denko K.K. as a brand name of KARENZ.

The crosslinked resin surface layer preferably includes the isocyanate including a radical polymerizable functional group in an amount of from 5 to 30% by weight. When less than 5% by weight, the effect thereof is not fully made. When greater than 30% by weight, the abrasion resistance and electrostatic properties of a photoreceptor are adversely affected.

The isocyanate including a radical polymerizable functional group may be chemically reacted with a heat-curable monomer before mixed in a crosslinked resin surface layer coating liquid, however, in the present invention, the isocyanate including a radical polymerizable functional group can directly be mixed therein. In this case, a radiation heat generated in light curing can be absorbed in a heat curing reaction when producing a urea or a urethane bonding, which means that damages against materials for the photosensitive layer or crosslinked resin surface layer with an excessive heat can be absorbed.

In the present invention, polyol having a polycaprolactone framework is preferably bonded with isocyanate, which is a cushion against a kinetic load in the crosslinked layer and protects the layer from being damaged. The isocyanate and hydroxyl groups preferably have a molar ratio (NCO/OH) of from 1/1.1 to 1/0.9, which lessens a ratio of unreacted monomers and often prevents the photoreceptor from having an electrostatic fatigue and being abraded.

Specific examples of the polycaprolactone framework include bifunctional polycaprolactone diols having the following formula (5):

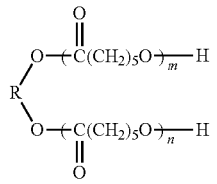

(5)

wherein m+n is an integer of from 4 to 35; and R represents $C_2H_4$, $C_2H_4OC_2H_4$ or $C(CH_3)_2(CH_2)_2$, trifunctional polycaprolactone triols having the following formula (6):

(6)

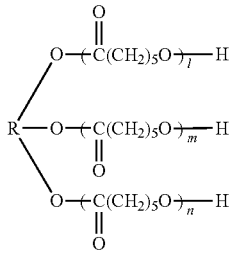

wherein l+m+n is an integer of from 3 to 30; and R represents $CH_2CHCH_2$, $CH_3C(CH_2)_3$, and $CH_3CH_2C(CH_2)_3$, and tetrafunctional polycaprolactone polyols.

Number of grades of the polycaprolactone polyols are marketed from Daicel Chemical Industries, Ltd. as a brand name of Praccell. As polyols having good self-curability, in addition to the above polycaprolactone polyols, polyester polyols BURNOCK, DS-1600, DS-1000 and DS-1300 marketed from DIC Corporation; and Self-curing CLEAR from Natoco Co., Ltd. are preferably used.

The curable charge transport material having the formulae (1), (2) or (4) is advantageously used to form a uniform cured layer as well as preparing a photoreceptor having good light attenuation chargeability. A metal halide lamp is conveniently irradiated to radically polymerize a coated layer. The charge transport material does not absorb light impairing the radical polymerization much when irradiated, which is advantageous to form a uniform layer. The crosslinked resin surface layer preferably includes the charge transport material not less than 5% by weight based on total weight of solid contents therein to substantially make the layer charge-transportable, and less than 60% by weight to save cost and prevent deterioration of the layer strength.

The curable charge transport material preferably has good charge acceptability from an underlying CTL and high charge transportability. A charge transportable monomer used for synthesizing a polymeric charge transport material, disclosed Japanese published unexamined application No. 2001-330973 is very effectively used. When a substance quantity (an equivalent) per one functional group curable a molecular framework is small, the content of a curing agent in the crosslinked resin surface layer increases, resulting in restriction of a maximum content of a curable charge transport material. The curable charge transport material preferably has a large equivalent, and specifically not less than 200. Particularly, it is reasonable to use the curable charge transport material having the formulae (1), (2) or (4).

Specific examples of the compound having the formula (1) include 4'-(di-p-tolylamino)-biphenyl-4-yl-ester acrylate, 2-methyl-4'-(di-p-tolylamino)-biphenyl-4-yl-ester acrylate, 4'-diphenylamino-biphenyl-4-yl-ester acrylate and 2-methyl-4'-diphenylamino-biphenyl-4-yl-ester acrylate.

Specific examples of the compound having the formula (2) include (4-[bis-(4-methoxyphenyl)-methyl]-diphenylamine, (4-[bis-(4-ethoxyphenyl)-methyl]-diphenyl-amine, (4-[bis-(4-methoxyphenyl)-methyl]-di-p-tolyl-amine and (4-[bis-(4-ethoxyphenyl)-methyl]-di-p-tolyl-amine.

Specific examples of the compound having the formula (4) include 4'-[(di-p-tolyl-amino)-biphenyl-4-yl-oxy]-methanol and 4'-[(di-p-tolyl-amino)-biphenyl-4-yl-oxy]-ethanol.

It is preferable that a dispersion solvent used for preparing the crosslinked resin surface layer coating liquid fully dissolves monomers, and specific examples thereof include ethers, aromatics, halogens, esters, cellosolves such as ethoxy ethanol and propylene glycols such as 1-methoxy-2-propanol. Methyl ethyl ketone, tetrahydrofuran, cyclohexanone and 1-methoxy-2-propanol are more preferably used than chlorobenzene, dichloromethane, toluene and xylene because of affecting the environment less. These solvents can be used alone or in combination.

Suitable coating methods of forming the crosslinked resin surface layer include a dip coating method, a spray coating method, a ring coating method, a roll coating method, a gravure coating method, a nozzle coating method and a screen printing method. In many cases, coating liquids do not have long pot lives, and therefore methods of performing necessary coating with a small amount of a coating liquid, i.e., the spray coating method and ring coat method are advantageously used in terms of environmental protection and cost.

UV irradiators such as high pressure mercury lamps and metal halide lamps having an emission wavelength of UV light can be used for forming the crosslinked resin surface layer. In addition, a visible light source adaptable to absorption wavelength of the radical polymerizing compounds and photo polymerization initiators can also be used. An irradiation light amount is preferably from 50 to 1,000 mW/cm$^2$. When less than 50 mW/cm$^2$, the curable reaction takes time. When greater than 1,000 mW/cm$^2$, the reaction nonuniformly proceeds, resulting in local wrinkles on the surface of crosslinked resin surface layer, and generation of a number of unreacted residues and reaction-ceased ends. Further, the rapid cross linking enlarges an internal stress, resulting in cracks and peeling of the layer.

The crosslinked resin surface layer can optionally include one or more low-molecular-weight compounds and leveling agents such as antioxidants, plasticizers, lubricants and ultraviolet absorbents as CGL, and the polymeric compounds as CTL. These can be used alone or in combination. A combination of the low-molecular-weight compounds and the leveling agents The low-molecular-weight compounds often causes deterioration of the sensitivity of a photoreceptor. Therefore, these are preferably included in the crosslinked resin surface layer in an approximate amount of from 0.1 to 20% by weight, and more preferably from 0.1 to 10% by weight based on total weight of solid contents in the coating liquid. The leveling agents are included therein in an approximate amount of from 0.1 to 5% by weight based thereon.

The crosslinked resin surface layer preferably has a thickness of from 3 to 15 μm. The minimum is on a cost-effective basis. The maximum is based on electrostatic properties such as charge stability and light attenuation sensitivity, and uniformity of the layer.

Hereinafter, the electrophotographic image forming apparatus of the present invention will be explained, referring to the drawings.

Figure 3:
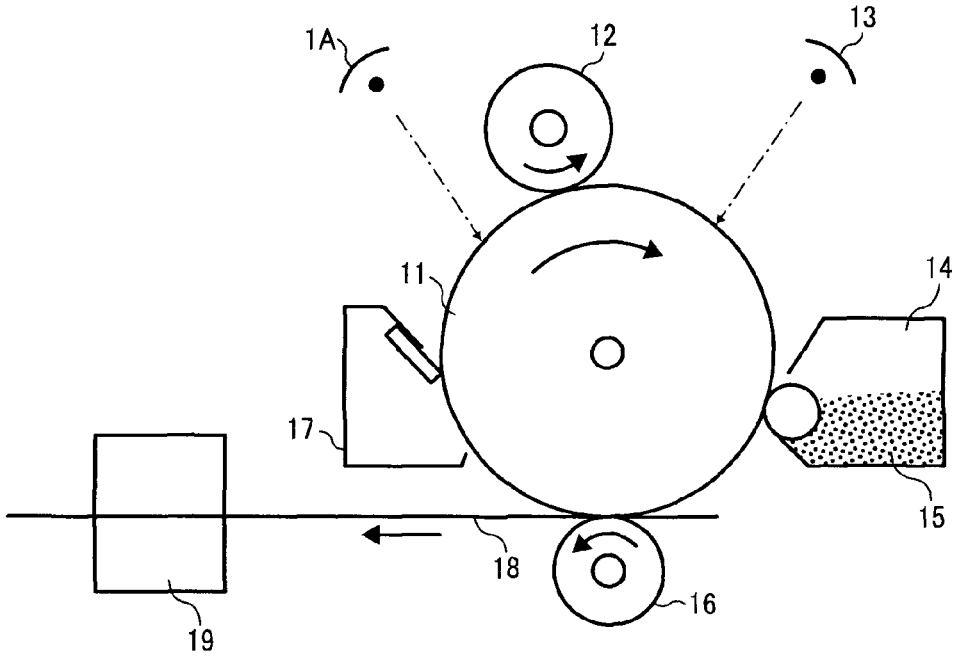
FIG. 3 is a schematic view illustrating an embodiment of the electrophotographic image forming apparatus of the present invention.

FIG. 3 is a schematic view illustrating an embodiment of the electrophotographic image forming apparatus of the present invention, and a modified embodiment as mentioned later belongs to a scope of the present invention.

In FIG. 3, a photoreceptor 11 is an electrophotographic photoreceptor including the crosslinked resin surface layer of the present invention. The photoreceptor 11 has the shape of a drum, and may have the shape of a sheet or an endless belt.

Any known chargers such as a corotron, a scorotron, a solid state charger and a charging roller can be used for a charger 12. A contact charger or a closely located charger to a photoreceptor is preferably used to decrease a power consumption. Particularly, the closely located charger to a photoreceptor, which has a proper gap therebetween is more preferably used to prevent a contamination of the charger. The above-mentioned chargers can be used as a transferer 16, and typically a combination of the transfer charger and separation charger is effectively used.

Suitable light sources for use in an imagewise light irradiator 13 and a discharger 1A include fluorescent lamps, tungsten lamps, halogen lamps, mercury lamps, sodium lamps, light emitting diodes (LEDs), laser diodes (LDs), light sources using electroluminescence (EL) and the like. In addition, in order to obtain light having a desired wavelength range, filters such as sharp-cut filters, band pass filters, near-infrared cutting filters, dichroic filters, interference filters, color temperature converting filters, etc. can be used.

When a toner image 15 formed on the photoreceptor by an image developer 14 is transferred onto an image receiving media 18, the toner image is not all transferred thereon, and a residual toner remains on the surface of the photoreceptor. The residual toner is removed by cleaner 17 from the photo receptor. Suitable cleaners include a rubber cleaning blade and a brush such as a fur brush and a mag-fur brush.

When a photoreceptor positively or negatively charged is exposed to imagewise light, an electrostatic latent image having a positive or negative charge is formed thereon. When the latent image having a positive charge is developed with a toner having a negative charge, a positive image can be obtained. In contrast, when the latent image having a positive charge is developed with a toner having a positive charge, a negative image (i.e., a reversal image) can be obtained.

Figure 4:
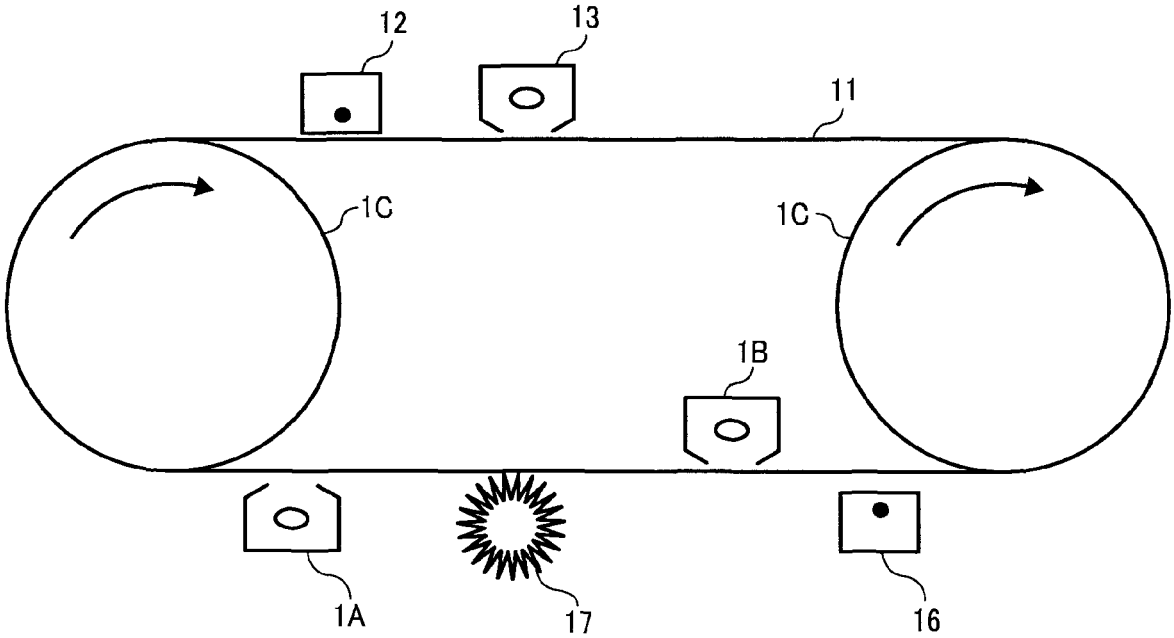
FIG. 4 is a schematic view illustrating another embodiment of the electrophotographic image forming apparatus of the present invention.

FIG. 4 is a schematic view illustrating another embodiment of the electrophotographic image forming apparatus of the present invention. In FIG. 4, a photoreceptor 11 is an electrophotographic photoreceptor including the crosslinked resin surface layer of the present invention. The photoreceptor 11 has the shape of a drum, and may have the shape of a sheet or an endless belt. The photoreceptor 11 is driven by a driver 1C. Charging using a charger 12, imagewise light exposure using an irradiator 13, developing (not shown), transferring using a transferer 16, pre-cleaning irradiating using a pre-cleaning irradiator 1B, cleaning using a cleaner 17 and discharging using a discharger 1A are repeatedly performed. In FIG. 4, the pre-cleaning irradiating is performed from a side of a substrate of the photoreceptor. In this case, the substrate has to be light-transmissive.

The electrophotographic image forming apparatuses of the present invention are not limited to those shown in FIGS. 3 and 4. For example, although the pre-cleaning irradiating is performed from the substrate side in FIG. 4, the pre-cleaning light irradiating can be performed from a photosensitive layer side of the photoreceptor. In addition, irradiating in the imagewise light irradiation process and the discharge process may be performed from the substrate side of the photoreceptor. On the other hand, imagewise light irradiation, pre-cleaning irradiation and discharge irradiation are shown in FIGS. 3 and 4, and other known irradiations such as pre-transfer irradiation, pre-imagewise-light-irradiation irradiation can be performed.

Figure 5:
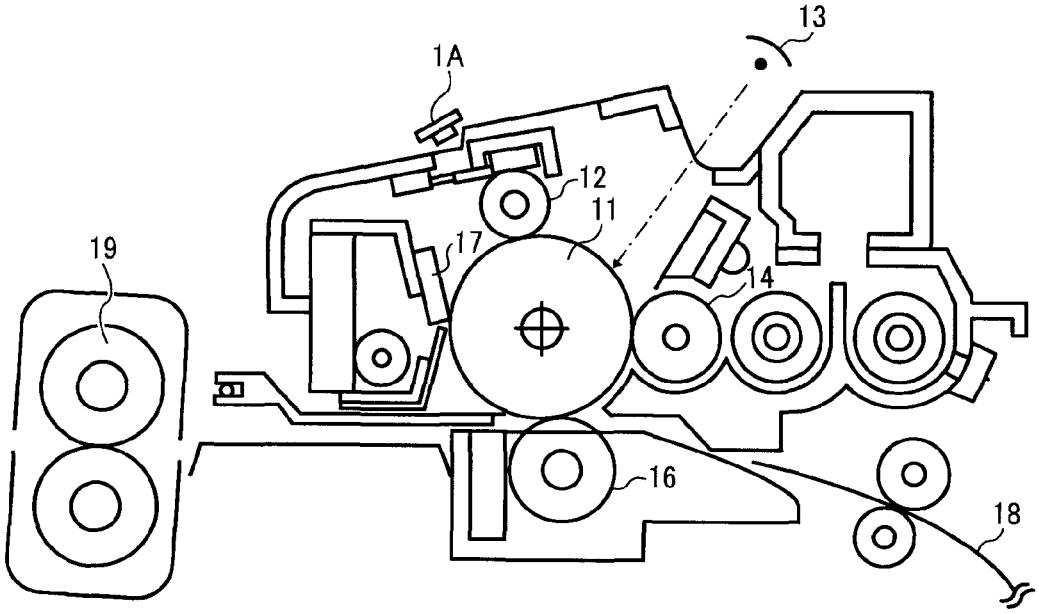
FIG. 5 is a schematic view illustrating an embodiment of the process cartridge of the present invention.

The above-mentioned electrophotographic image forming apparatuses may fixedly be set in a copier, a facsimile or a printer, and may be set therein as a process cartridge. The process cartridge in the present invention includes a photoreceptor, and at least one of a charger, an irradiator, an image developer, a transferer, a cleaner and a discharger. The process cartridge has many shapes, and an embodiment thereof is shown in FIG. 5. The photoreceptor 11 has the shape of a drum, and may have the shape of a sheet or an endless belt.

Figure 6:
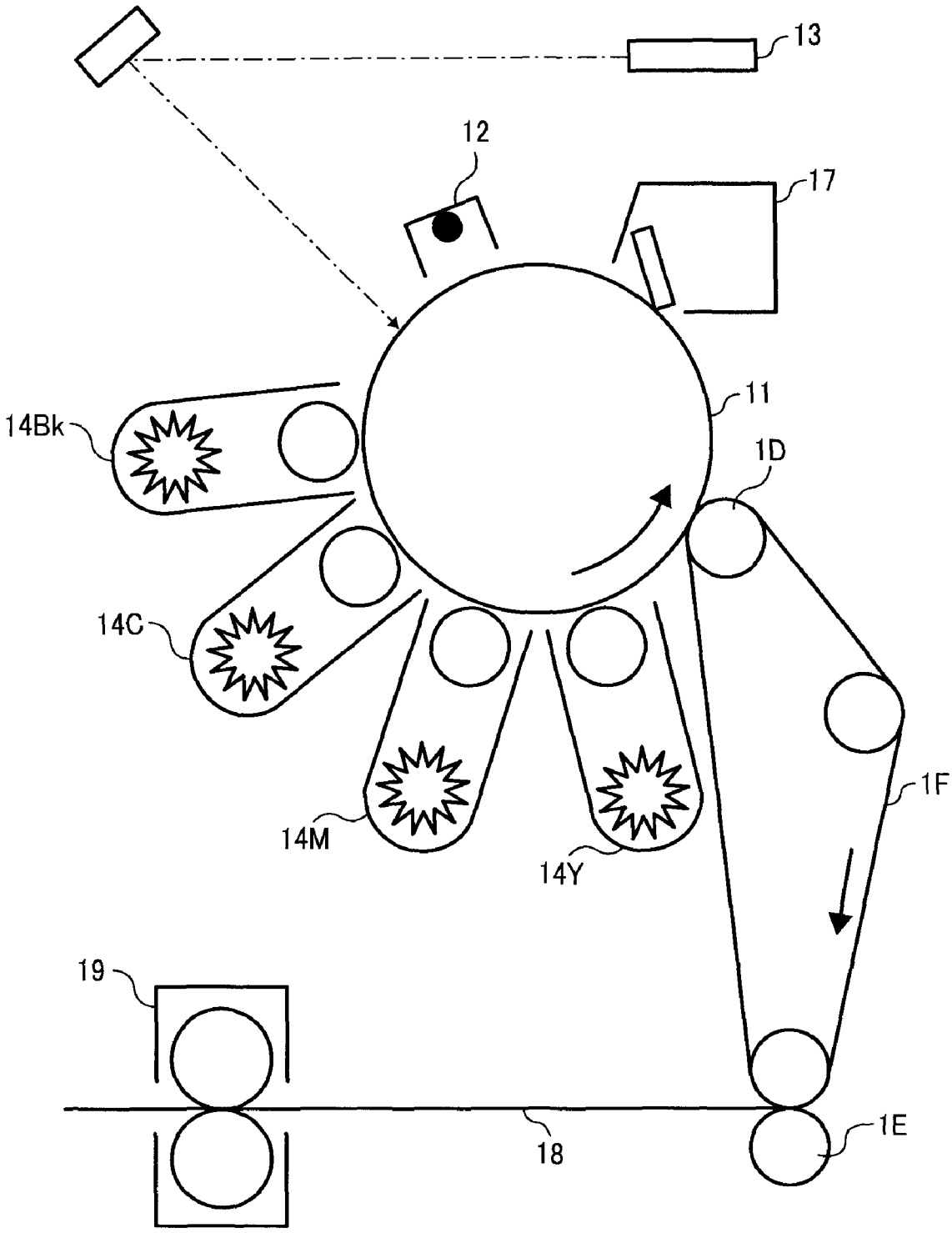
FIG. 6 is a schematic view illustrating a further embodiment of the electrophotographic image forming apparatus of the present invention.

FIG. 6 is a schematic view illustrating a further embodiment of the electrophotographic image forming apparatus of the present invention. The electrophotographic image forming apparatus includes a photoreceptor 11; and a charger 12, in irradiator 13, image developers 14Bk, 14C, 14M and 14Y for each color toner of black (Bk), cyan (C), magenta (M) and yellow (Y), an intermediate transfer belt 1F as an intermediate transferee and a cleaner 17 around the photoreceptor. The photoreceptor 11 is an electrophotographic photoreceptor including the crosslinked resin surface layer of the present invention. The image developers 14Bk, 14C, 14M and 14Y can independently be controlled, and only the image developer forming a color is driven. A toner image formed on the photoreceptor 11 is transferred onto an intermediate transfer belt 1F by a first transferer 1D located inside the intermediate transfer belt 1F. The first transferer 1D is located so as to be capable of contacting and releasing from the photoreceptor 11, and contacts the intermediate transfer belt 1F to the photoreceptor 11 only when transferring a toner image. After each color toner image layered on the intermediate transfer belt 1F is transferred onto an image receiving media 18 at a time by a second transferer 1E, the toner image is fixed thereon by a fixer 19. The second transferer 1E is also located so as to be capable of contacting and releasing from the photoreceptor 11, and contacts the intermediate transfer belt 1F to the photoreceptor 11 only when transferring a toner image.

While an electrophotographic image forming apparatus using a transfer drum cannot print on a thick paper because a transfer material electrostatically sticks to the transfer drum, the electrophotographic image forming apparatus using an intermediate transferer in FIG. 6 does not have a limit of the transfer material because each color toner image is layered on the intermediate transfer belt 1F. Such an intermediate transferer can be applied not only to the apparatus in FIG. 6 but also to the apparatuses in FIGS. 3 to 5, 7 and 8 mentioned later.

Figure 7:
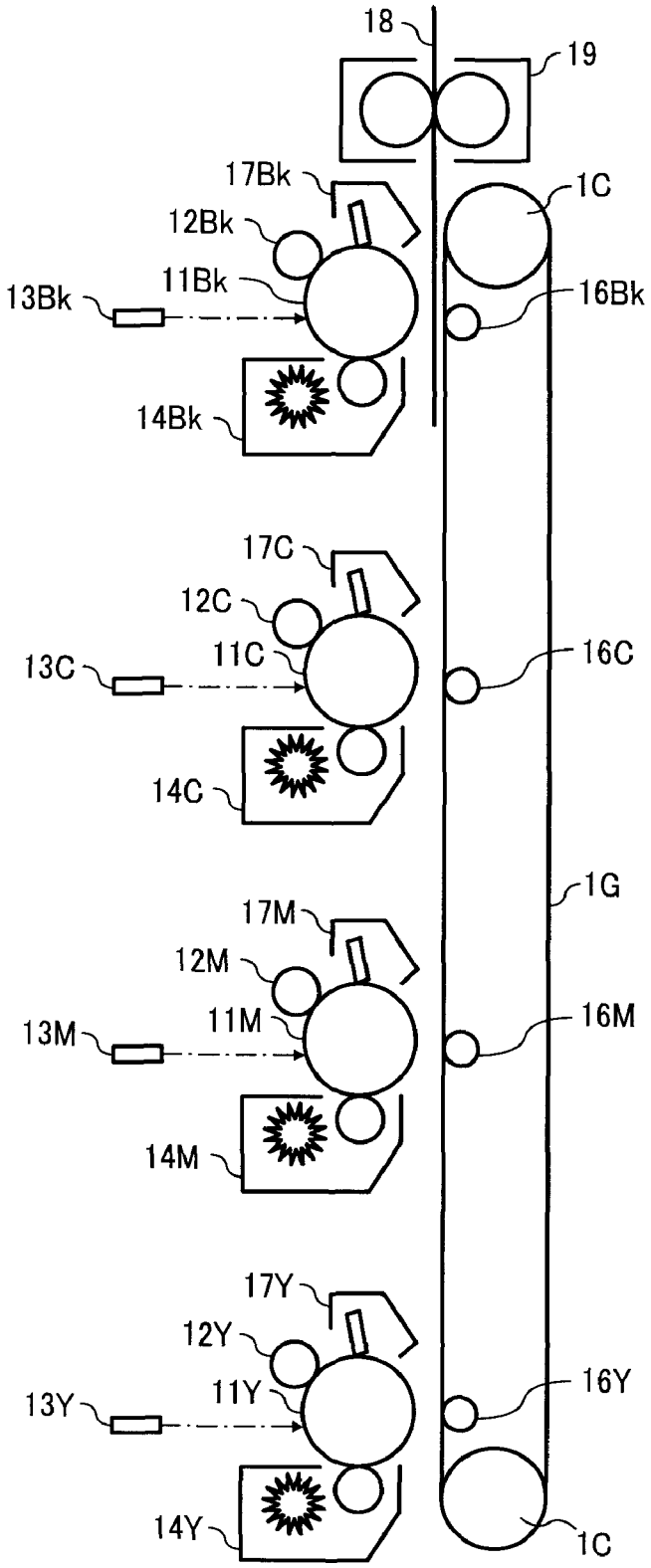
FIG. 7 is a schematic view illustrating another embodiment of the electrophotographic image forming apparatus of the present invention.
Figure 8:
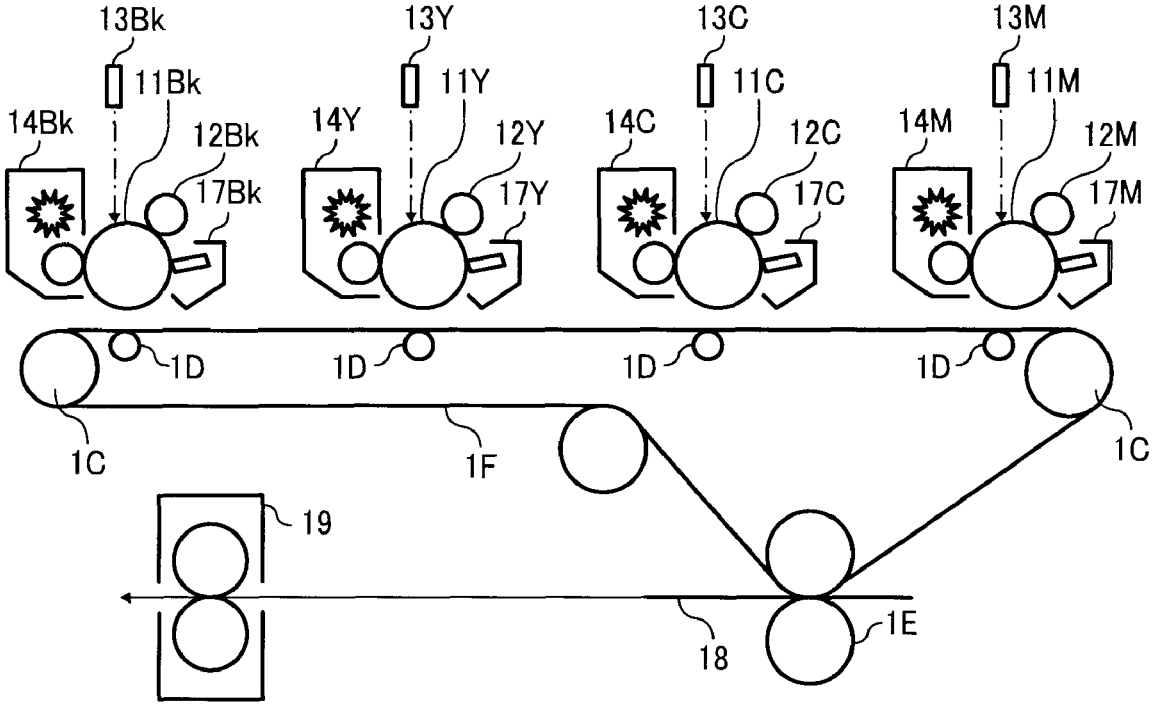
FIG. 8 is a schematic view illustrating a further embodiment of the electrophotographic image forming apparatus of the present invention.

FIG. 7 is a schematic view illustrating another embodiment of the electrophotographic image forming apparatus of the present invention. This electrophotographic image forming apparatus uses four color toners, i.e., a yellow (Y) toner, a magenta (M) toner, cyan (C) toner and black (Bk) toner, and has image forming units and photoreceptors 11Y, 11M, 11C and 11Bk for each color. The photoreceptor 11 is an electrophotographic photoreceptor including the crosslinked resin surface layer of the present invention. Around each of the photoreceptors 11Y, 11M, 11C and 11Bk, a charger 12, an irradiator 13, an image developer 14 and a cleaner 17, etc. are located. A transport transfer belt 1G as a transfer material bearer contacting and leaving from each transfer position of each photoreceptor 11Y, 11M, 11C and 11Bk is hung over a driver 1C. A transferer 16 is located at a transfer position opposite to each of the photoreceptors 11Y, 11M, 11C and 11Bk across the transport transfer belt 1G.

The electrophotographic image forming apparatus as shown in FIG. 7 has photoreceptors 11Y, 11M, 11C and 11Bk for each color and sequentially transfer each color toner image onto an image receiving media 18 borne by the transport transfer belt 1G, and therefore can produce full-color images at a far higher-speed than that of a full-color image forming apparatus having only one photoreceptor.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, the measuring methods for use in the present invention will be explained.

(1) Surface Roughness

A ten-point average surface roughness Rz (JIS 0601;1982) of a drum-shaped photoreceptor was measured by a stylus surface roughness gauge Surfcom from Tokyo Seimitsu Co., Ltd., having a pickup E-DT-S02A therefrom. Specifically, the measurement was performed according to a procedure in an operation manual of the stylus surface roughness gauge. Respective centers of a trisected photoreceptor were measured twice, and an average of total six-time measurements was determined.

(2) Image Quality

An alternate square 2 dots blank and black pattern image was produced by a full-color copier imagio Neo C455 from Ricoh Company, Ltd. at a resolution of 1200 dpi×1200 dpi on a PPC paper TYPE-6200 from Ricoh Company, Ltd. The image was evaluated and classified into the following 5 grades. The specific procedure will be mentioned later.

5: very good
4: good
3: no problem
2: slightly dull, but no practical problem
1: dull

Example 1

An undercoat layer coating liquid, a CGL coating liquid and a CTL coating liquid having the following compositions respectively were coated in this order on an aluminum drum having a thickness of 0.8 mm, a length of 340 mm and an outer diameter of 40 mm and then dried to form an undercoat layer having a thickness of 3.5 μm and overlying aluminum drum, a CGL having a thickness of 0.2 μm and overlying the undercoat layer, and a CTL having a thickness of 19 μm and overlying the CGL. Further, after a crosslinked resin surface layer coating liquid having the following composition was sprayed on the CTL, the surface layer was irradiated with UV light from UV curing lamp to be cured at a luminance of 600 mW/cm$^2$ hen measured by an UV integral actinometer UIT-150 from Ushio, Inc. and at a distance of 112 mm while the drum was rotated at 55 rpm. While the surface layer was irradiated continuously with UV light for 4 min, water having a temperature of 30° C. was circulated in the aluminum drum. After cured, the surface layer was heated and dried at 130° C. for 30 min to form a crosslinked resin surface layer having a thickness of 3.5 μm on the CTL. Thus, an electrophotographic photoreceptor was prepared.

| [Undercoat layer coating liquid] | |
|---|---|
| Alkyd resin solution (BEKKOLITE M6401-50 from Dainippon Ink & Chemicals, Inc.) | 12 |
| Melamine resin solution (SUPER BEKKAMIN G-821-60 from Dainippon Ink & Chemicals, Inc.) | 8 |
| Titanium dioxide (CR-EL from Ishihara Sangyo Kaisha Ltd.) | 40 |
| Methyl ethyl ketone | 200 |
| [CGL coating liquid] | |
| Bisazo pigment having the following formula: (from Ricoh Company, Ltd.) | 5 |

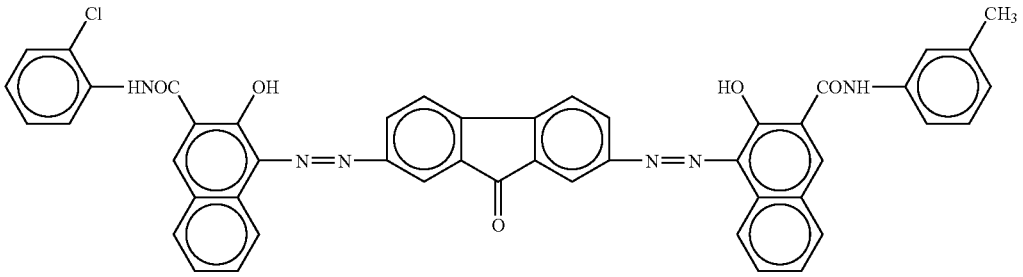

| | |
|---|---|
| Polyvinyl butyral (XYHL from Union Carbide Corp.) | 1 |
| Cyclohexanone | 200 |
| Methyl ethyl ketone | 80 |
| [CTL coating liquid] | |
| Z-type polycarbonate (Panlite ® TS-2050 from TEIJIN CHEMICALS LTD.) | 10 |
| Low-molecular-weight charge transport material having the following formula: | 7 |

-continued

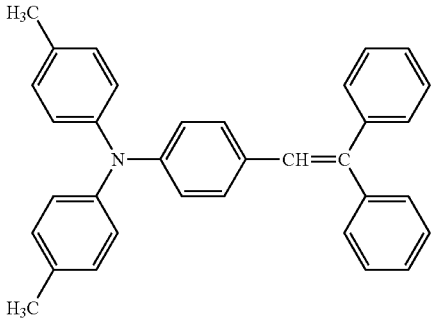

| | |
|---|---|
| Tetrahydrofuran | 100 |
| 1% silicone oil solution in tetrahydrofuran (KF50-100CS from Shin-Etsu Chemical Industry Co., Ltd.) | 1 |
| [Crosslinked resin surface layer coating liquid] | |
| Crosslinked charge transport material having the following formula: | 40 |

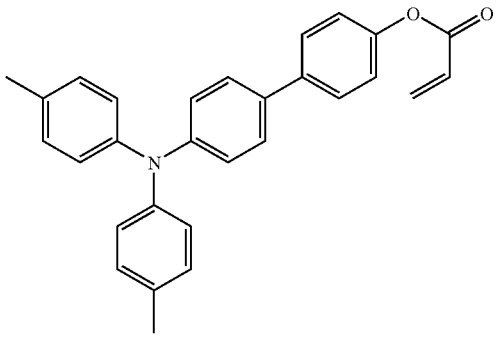

| | |
|---|---|
| Trimethylolpropanetriacrylate (KAYARAD TMPTA from Nippon Kayaku Co., Ltd.) | 60 |
| Mixture of Polyester-modified Polydimethylsiloxane and propoxy-modified-2-neopentylglycoldiacrylate (BYK-UV3570 from BYK-Chemie GmbH) | 0.1 |
| 1-hydroxy-cyclohexyl-phenyl-ketone (IRGACURE 184 from Ciba Specialty Chemicals) | 5 |
| 2-methacryloyloxyethylisocyanate (KARENZ MOI from Showa Denko K.K.) | 16 |
| Polycaprolactonetriol (Praccell 305 from Daicel Chemical Industries, Ltd.) | 18 |
| Tetrahydrofuran | 700 |

Example 2

The procedure for preparation of the electrophotographic photoreceptor in Example 1 was repeated except for changing 16 parts of 2-methacryloyloxyethylisocyanate into 15 parts of 2-acryloyloxyethylisocyanate (KARENZ AOI from Showa Denko K.K.), and from 18 to 19 parts of polycaprolactonetriol.

Example 3

The procedure for preparation of the electrophotographic photoreceptor in Example 1 was repeated except for changing 16 parts of 2-methacryloyloxyethylisocyanate into 14 parts of 1,1-bis(acryloyloxymethyl)ethylisocyanate (KARENZ BEI from Showa Denko K.K.), and from 18 to 19 parts of polycaprolactonetriol.

Example 4

The procedure for preparation of the electrophotographic photoreceptor in Example 1 was repeated except for changing the crosslinked resin surface layer coating liquid into one having the following composition.

| | |
|---|---|
| [Crosslinked resin surface layer coating liquid] | |
| Crosslinked charge transport material having the following formula: | 28 |

-continued

[Crosslinked resin surface layer coating liquid]

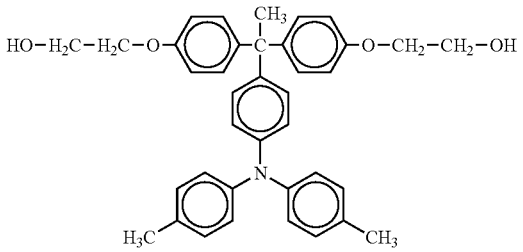

| | |
|---|---|
| 2-methacryloyloxyethylisocyanate (KARENZ MOI from Showa Denko K.K.) | 30 |
| Polycaprolactonetriol (Praccell 305 from Daicel Chemical Industries, Ltd.) | 18 |
| Trimethylolpropanetriacrylate (KAYARAD TMPTA from Nippon Kayaku Co., ltd.) | 60 |
| Mixture of Polyester-modified Polydimethylsiloxane and propoxy-modified-2-neopentylglycoldiacrylate (BYK-UV3570 from BYK-Chemie GmbH) | 0.1 |
| 1-hydroxy-cyclohexyl-phenyl-ketone (IRGACURE 184 from Ciba Specialty Chemicals) | 5 |
| Tetrahydrofuran | 700 |

Example 5

The procedure for preparation of the electrophotographic photoreceptor in Example 1 was repeated except for changing the crosslinked resin surface layer coating liquid into one having the following composition.

[Crosslinked resin surface layer coating liquid]

Crosslinked charge transport material having the following formula: 29

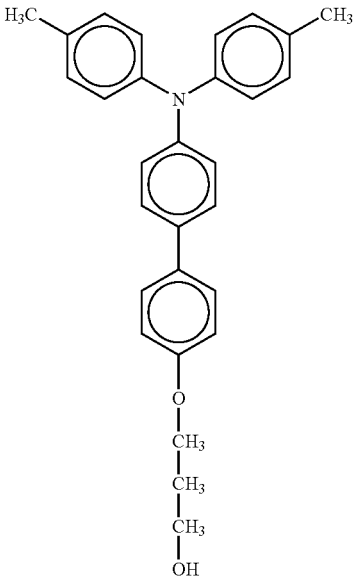

| | |
|---|---|
| 2-methacryloyloxyethylisocyanate (KARENZ MOI from Showa Denko K.K.) | 29 |
| Polycaprolactonetriol (Praccell 305 from Daicel Chemical Industries, Ltd.) | 18 |
| Trimethylolpropanetriacrylate (KAYARAD TMPTA from Nippon Kayaku Co., Ltd.) | 60 |
| Mixture of Polyester-modified Polydimethylsiloxane and propoxy-modified-2-neopentylglycoldiacrylate (BYK-UV3570 from BYK-Chemie GmbH) | 0.1 |
| 1-hydroxy-cyclohexyl-phenyl-ketone (IRGACURE 184 from Ciba Specialty Chemicals) | 5 |
| Tetrahydrofuran | 700 |

Comparative Example 1

The procedure for preparation of the electrophotographic photoreceptor in Example 1 was repeated except for changing the crosslinked resin surface layer coating liquid into one having the following composition.

[Crosslinked resin surface layer coating liquid]

Crosslinked charge transport material having the following formula: 50

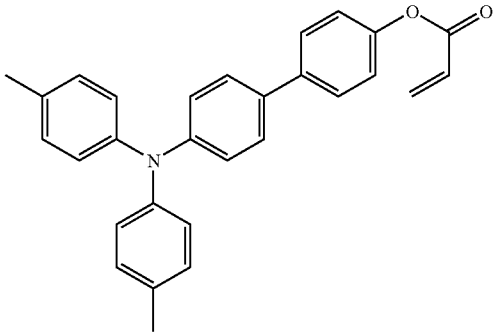

| | |
|---|---|
| Trimethylolpropanetriacrylate (KAYARAD TMPTA from Nippon Kayaku Co., Ltd.) | 50 |
| Mixture of Polyester-modified Polydimethylsiloxane and propoxy-modified-2-neopentylglycoldiacrylate (BYK-UV3570 from BYK-Chemie GmbH) | 0.1 |
| 1-hydroxy-cyclohexyl-phenyl-ketone (IRGACURE 184 from Ciba Specialty Chemicals) | 5 |
| Tetrahydrofuran | 700 |

Comparative Example 2

The procedure for preparation of the electrophotographic photoreceptor in Example 1 was repeated except for excluding 2-methacryloyloxyethylisocyanate and polycaprolactonetriol.

Reference Example 1

The procedure for preparation of the electrophotographic photoreceptor in Example 1 was repeated except for changing the crosslinked resin surface layer coating liquid into one having the following composition.

| [Crosslinked resin surface layer coating liquid] | |
|---|---|
| Crosslinked charge transport material having the following formula: | 16 |

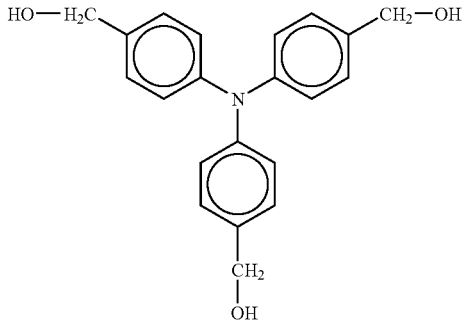

| | |
|---|---|
| 2-methacryloyloxyethylisocyanate (KARENZ MOI from Showa Denko K.K.) | 42 |
| Polycaprolactonetriol (Praccell 305 from Daicel Chemical Industries, Ltd.) | 18 |
| Trimethylolpropanetriacrylate (KAYARAD TMPTA from Nippon Kayaku Co., Ltd.) | 60 |
| Mixture of Polyester-modified Polydimethylsiloxane and propoxy-modified-2-neopentylglycoldiacrylate (BYK-UV3570 from BYK-Chemie GmbH) | 0.1 |
| 1-hydroxy-cyclohexyl-phenyl-ketone (IRGACURE 184 from Ciba Specialty Chemicals) | 5 |
| Tetrahydrofuran | 700 |

Reference Example 2

The procedure for preparation of the electrophotographic photoreceptor in Example 1 was repeated except for changing the crosslinked resin surface layer coating liquid into one having the following composition.

| [Crosslinked resin surface layer coating liquid] | |
|---|---|
| Crosslinked charge transport material having the following formula: | 40 |

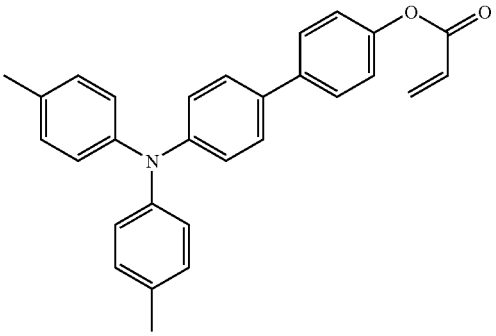

| | |
|---|---|
| Trimethylolpropanetriacrylate (KAYARAD TMPTA from Nippon Kayaku Co., Ltd.) | 60 |
| Mixture of Polyester-modified Polydimethylsiloxane and propoxy-modified-2-neopentylglycoldiacrylate (BYK-UV3570 from BYK-Chemie GmbH) | 0.1 |
| 1-hydroxy-cyclohexyl-phenyl-ketone (IRGACURE 184 from Ciba Specialty Chemicals) | 5 |
| 2-methacryloyloxyethylisocyanate (KARENZ MOI from Showa Denko K.K.) | 24 |

-continued

| [Crosslinked resin surface layer coating liquid] | |
|---|---|
| 2, 3-butanediol | 3 |
| Tetrahydrofuran | 700 |

The electrophotographic photoreceptors prepared in Examples 1 to 5, Comparative Examples 1 to 2 and Reference Examples 1 to 2 were installed in the black development station of imagio Neo C455 from Ricoh Company, Ltd., and each 5 pieces of a text and a graphic image having a pixel of 600 dpi×600 dpi and an image density of 5% were continuously produced on 50,000 copy papers TYPE 6000 from Ricoh Company, Ltd.

All zinc stearate sticks for the photoreceptors were removed.

A load spring for the cleaning blade was replaced with a SUS spring having a spring load of 0.40 N/mm, a free length of 14 mm and an inner diameter of 5 mm.

A genuine toner and developer, and a genuine photoreceptor unit of imagio Neo C455 were used. An AC component of a voltage applied to the charging roller was 1.5 kV between peaks and had a frequency of 0.9 kHz. A DC component had a bias such that the photoreceptor had a charged potential of −700 V from start to finish the running test. The developing bias was −500 V. The imagio Neo C455 did not have a discharger. The cleaner was replaced every time when 50,000 images were produced. The running test was performed at 24° C. and 54% RH. After the running test, a halftone pattern in which 2 dots×2 dots were drawn in 4×4 matrix at a pixel of 1,200 dpi×1,200 dpi was produced on a PPC paper TYPE-6200A4.

The evaluation results of image quality and surface roughness of respective Examples 1 to 5, Comparative Examples 1 to 2 and Reference Examples 1 to 2 are shown in the following Table 1.

TABLE 1

| | Image Quality | | Surface Roughness Rz(μm) | |
|---|---|---|---|---|
| | Before test | After test | Before test | After test |
| Example 1 | 5 | 4 | 0.2 | 0.2 |
| Example 2 | 5 | 4 | 0.3 | 0.3 |
| Example 3 | 5 | 4 | 0.2 | 0.2 |
| Example 4 | 5 | 4 | 0.3 | 0.3 |
| Example 5 | 5 | 4 | 0.2 | 0.2 |
| Comparative Example 1 | 5 | 2 | 0.3 | 1.2 |
| Comparative Example 2 | 5 | 2 | 0.3 | 1.0 |
| Reference Example 1 | 5 | 3 | 0.2 | 0.3 |
| Reference Example 2 | 5 | 3 | 0.2 | 0.8 |

The photoreceptors prepared in Examples 1 to 5 produced images having quality better than the photoreceptor prepared in Comparative Example 1. The photoreceptor had no damages on the surface and maintained smoothness thereof. The photoreceptors prepared in Comparative Examples 1 and 2 produced images having low image density after producing several images. The layer forming conditions were so severe that a part of each surface layer is thought to deteriorate.

The photoreceptors prepared in Examples 1 to 3 included 3 kinds of isocyanate including a radical polymerizable functional group, respectively. Each crosslinked resin layer had good durability. These materials have good affinity to a curing reaction between trimethylolpropanetriacrylate and a heat or a light-curing charge transport material.

Each of the photoreceptors prepared in Examples 4 to 5 included a heat or a light-curing charge transport material. The photoreceptors produced images having good quality before and after the test. Although having good damage resistance, the photoreceptor prepared in Reference Example 1 is thought to have rather insufficient sensitivity because of producing image having lower image density.

The photoreceptor prepared in Reference Example 2 did not include caprolactone-modified polyol which is though to have effects on maintenance of the surface smoothness and production of quality images, and had a surface smoothness lower than those of the photoreceptors prepared in Examples 1 to 5 and produced images having quality lower than those thereof.

Example 6

The procedure for preparation of the electrophotographic photoreceptor in Example 1 was repeated except for changing the crosslinked resin surface layer coating liquid into one having the following composition.

| [Crosslinked resin surface layer coating liquid] | |
|---|---|
| Crosslinked charge transport material having the following formula: | 40 |

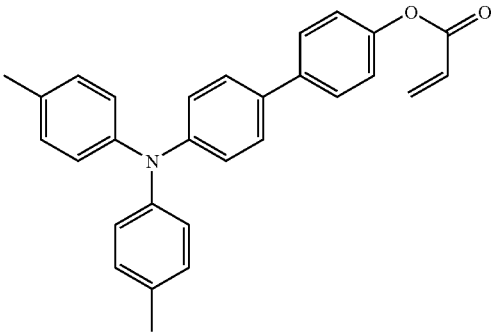

| | |
|---|---|
| Trimethylolpropanetriacrylate (KAYARAD TMPTA from Nippon Kayaku Co., Ltd.) | 20 |
| Caprolactone-modified dipentaerythritolhexaacrylate (KAYARAD DPCA-120 from Nippon Kayaku Co., Ltd.) | 20 |
| Mixture of Polyester-modified Polydimethylsiloxane and propoxy-modified-2-neopentylglycoldiacrylate (BYK-UV3570 from BYK-Chemie GmbH) | 0.1 |
| 1-hydroxy-cyclohexyl-phenyl-ketone (IRGACURE 184 from Ciba Specialty Chemicals) | 5 |
| 1,1-bis(acryloyloxymethyl) ethylisocyanate (KARENZ BEI from Showa Denko K.K.) | 2 |
| Hydrolyzed condensate of alkoxysilane (NNSC3456 from Nippon Fine Chemical Co., Ltd.) | 20 |
| Tetrahydrofuran | 700 |

Example 7

The procedure for preparation of the electrophotographic photoreceptor in Example 6 was repeated except for changing 2 parts of 1,1-bis(acryloyloxymethyl)ethylisocyanate into 6 parts thereof.

Comparative Example 3

The procedure for preparation of the electrophotographic photoreceptor in Example 6 was repeated except for excluding 2 parts of 1,1-bis(acryloyloxymethyl)ethylisocyanate.

The electrophotographic photoreceptors prepared in Examples 6 to 7 and Comparative Example 3 were installed in the black development station of imagio Neo C455 from Ricoh Company, Ltd., and each 5 pieces of a text and a graphic image having a pixel of 600 dpi×600 dpi and an image density of 5% were continuously produced on 50,000 copy papers TYPE 6000 from Ricoh Company, Ltd.

All zinc stearate sticks for the photoreceptors were removed.

A load spring for the cleaning blade was replaced with a SUS spring having a spring load of 0.40 N/mm, a free length of 14 mm and an inner diameter of 5 mm.

A genuine toner and developer, and a genuine photoreceptor unit of imagio Neo C455 were used. An AC component of a voltage applied to the charging roller was 1.5 kV between peaks and had a frequency of 0.9 kHz. A DC component had a bias such that the photoreceptor had a charged potential of −700 V from start to finish the running test. The developing bias was −500 V. The imagio Neo C455 did not have a discharger. The cleaner was replaced every time when 50,000 images were produced. The running test was performed at 24° C. and 54% RH. After the running test, a halftone pattern in which 2 dots×2 dots were drawn in 4×4 matrix at a pixel of 1,200 dpi×1,200 dpi was produced on a PPC paper TYPE-6200A4.

The evaluation results of image quality and surface roughness of respective Examples 6 to 7 and Comparative Example 3 are shown in the following Table 2.

TABLE 2

| | Image Quality | | Surface Roughness Rz(μm) | |
|---|---|---|---|---|
| | Before test | After test | Before test | After test |
| Example 6 | 5 | 3 | 0.4 | 0.6 |
| Example 7 | 5 | 4 | 0.3 | 0.3 |
| Comparative Example 3 | 5 | 2 | 0.4 | 1.5 |

The photoreceptors prepared in Examples 6 and 7 produced quality images before and after the test, and the photoreceptor prepared in Comparative Example 3 produced images having blank spots having the shape of rice-fish. The photoreceptors prepared in Examples 6 and 7 and Comparative Example 3 had an average Martens hardness of 176 (standard deviation of 3.96), 182 (standard deviation of 1.49) and 169 (standard deviation of 22.3), respectively when measured for 15 times. The photoreceptors prepared in Examples 6 and 7 had high hardness and low variation while the photoreceptor prepared in Comparative Example 3 had low hardness and high variation. A large difference between Examples 6 and 7, and Comparative Example 3 is whether the crosslinked surface layer coating liquid includes 1,1-bis(acryloyloxymethyl)ethylisocyanate. Isocyanate including a radical polymerizable functional group is effectively used as a heat curing resin when included in an UV curing resin.

Example 8

The procedure for preparation of the electrophotographic photoreceptor in Example 1 was repeated except for changing the crosslinked resin surface layer coating liquid into one having the following composition.

| [Crosslinked resin surface layer coating liquid] | |
|---|---|
| Crosslinked charge transport material having the following formula: | 40 |

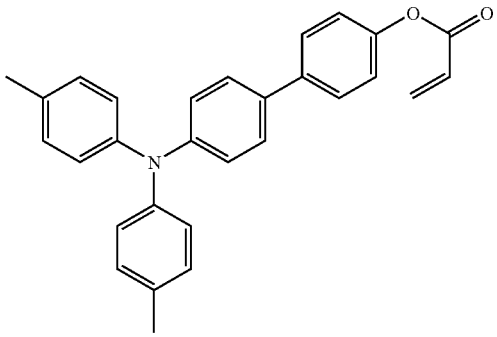

| | |
|---|---|
| Trimethylolpropanetriacrylate (KAYARAD TMPTA from Nippon Kayaku Co., Ltd.) | 20 |
| Caprolactone-modified dipentaerythritolhexaacrylate (KAYARAD DPCA-120 from Nippon Kayaku Co., Ltd.) | 20 |
| Mixture of Polyester-modified Polydimethylsiloxane and propoxy-modified-2-neopentylglycoldiacrylate (BYK-UV3570 from BYK-Chemie GmbH) | 0.1 |
| 1-hydroxy-cyclohexyl-phenyl-ketone (IRGACURE 184 from Ciba Specialty Chemicals) | 5 |
| 2-acryloyloxyethylisocyanate (KARENZ AOI from Showa Denko K.K.) | 15 |
| Polycaprolactonetriol (Praccell 308 from Daicel Chemical Industries, Ltd.) | 18 |
| Tetrahydrofuran | 700 |

Comparative Example 4

The procedure for preparation of the electrophotographic photoreceptor in Example 1 was repeated except for changing the crosslinked resin surface layer coating liquid into one having the following composition.

| [Crosslinked resin surface layer coating liquid] | |
|---|---|
| Crosslinked charge transport material having the following formula: | 40 |

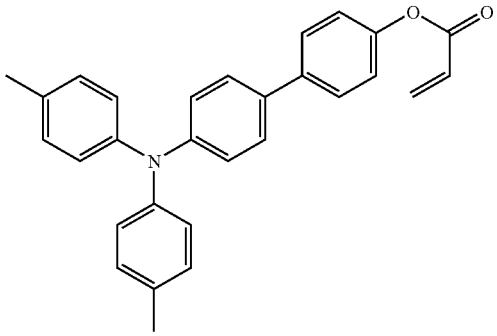

| | |
|---|---|
| Caprolactone-modified dipentaerythritolhexaacrylate (KAYARAD DPCA-120 from Nippon Kayaku Co., Ltd.) | 40 |
| Mixture of Polyester-modified Polydimethylsiloxane and propoxy-modified-2-neopentylglycoldiacrylate | 0.1 |

-continued

| [Crosslinked resin surface layer coating liquid] | |
|---|---|
| (BYK-UV3570 from BYK-Chemie GmbH) | |
| 1-hydroxy-cyclohexyl-phenyl-ketone (IRGACURE 184 from Ciba Specialty Chemicals) | 5 |
| 2-acryloyloxyethylisocyanate (KARENZ AOI from Showa Denko K.K.) | 5 |
| Polycaprolactonetriol (Praccell 308 from Daicel Chemical Industries, Ltd.) | 10 |
| Tetrahydrofuran | 700 |

Comparative Example 5

The procedure for preparation of the electrophotographic photoreceptor in Example 1 was repeated except for changing the crosslinked resin surface layer coating liquid into one having the following composition.

| [Crosslinked resin surface layer coating liquid] | |
|---|---|
| Crosslinked charge transport material having the following formula: | 50 |

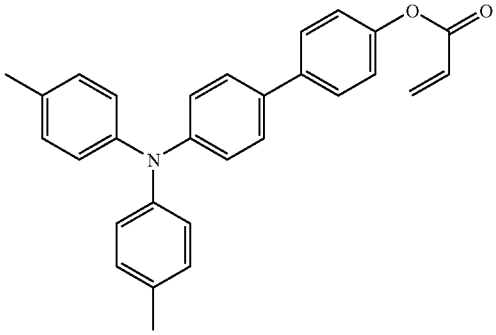

| | |
|---|---|
| Trimethylolpropanetriacrylate (KAYARAD TMPTA from Nippon Kayaku Co., Ltd.) | 25 |
| Caprolactone-modified dipentaerythritolhexaacrylate (KAYARAD DPCA-120 from Nippon Kayaku Co., Ltd.) | 25 |
| Mixture of Polyester-modified Polydimethylsiloxane and propoxy-modified-2-neopentylglycoldiacrylate (BYK-UV3570 from BYK-Chemie GmbH) | 0.1 |
| 1-hydroxy-cyclohexyl-phenyl-ketone (IRGACURE 184 from Ciba Specialty Chemicals) | 5 |
| Tetrahydrofuran | 700 |

Comparative Example 6

The procedure for preparation of the electrophotographic photoreceptor in Example 1 was repeated except for changing the crosslinked resin surface layer coating liquid into one having the following composition.

| [Crosslinked resin surface layer coating liquid] | |
|---|---|
| Crosslinked charge transport material having the following formula: | 40 |

-continued

[Crosslinked resin surface layer coating liquid]

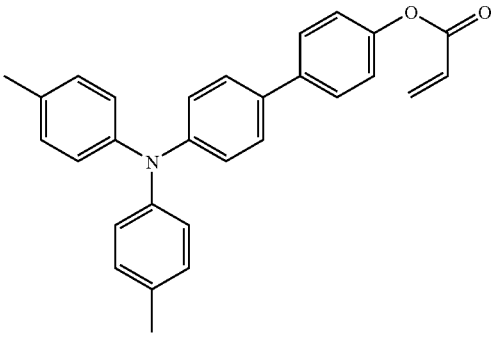

| | |
|---|---|
| Caprolactone-modified dipentaerythritolhexaacrylate (KAYARAD DPCA-120 from Nippon Kayaku Co., Ltd.) | 60 |
| 2-acryloyloxyethylisocyanate (KARENZ AOI from Showa Denko K.K.) | 15 |
| Polycaprolactonetriol (Praccell 305 from Daicel Chemical Industries, Ltd.) | 19 |
| Mixture of Polyester-modified Polydimethylsiloxane and propoxy-modified-2-neopentylglycoldiacrylate (BYK-UV3570 from BYK-Chemie GmbH) | 0.1 |
| 1-hydroxy-cyclohexyl-phenyl-ketone (IRGACURE 184 from Ciba Specialty Chemicals) | 5 |
| Tetrahydrofuran | 700 |

Comparative Example 7

The procedure for preparation of the electrophotographic photoreceptor in Example 4 was repeated except for changing the crosslinked resin surface layer coating liquid into one having the following composition.

[Crosslinked resin surface layer coating liquid]

Crosslinked charge transport material 28
having the following formula:

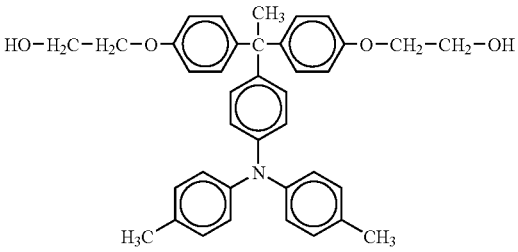

| | |
|---|---|
| 2-methacryloyloxyethylisocyanate (KARENZ MOI from Showa Denko K.K.) | 30 |
| Polycaprolactonetriol (Praccell 305 from Daicel Chemical Industries, Ltd.) | 30 |
| Caprolactone-modified dipentaerythritolhexaacrylate (KAYARAD DPCA-120 from Nippon Kayaku Co., Ltd.) | 60 |
| Mixture of Polyester-modified Polydimethylsiloxane and propoxy-modified-2-neopentylglycoldiacrylate (BYK-UV3570 from BYK-Chemie GmbH) | 0.1 |
| 1-hydroxy-cyclohexyl-phenyl-ketone (IRGACURE 184 from Ciba Specialty Chemicals) | 5 |
| Tetrahydrofuran | 700 |

The electrophotographic photoreceptors prepared in Example 8 and Comparative Examples 4 to 7 were installed in the black development station of imagio Neo C455 from Ricoh Company, Ltd., and each 5 pieces of a text and a graphic image having a pixel of 600 dpi×600 dpi and an image density of 5% were continuously produced on 50,000 copy papers TYPE 6000 from Ricoh Company, Ltd.

All zinc stearate sticks for the photoreceptors were removed.

A load spring for the cleaning blade was replaced with a SUS spring having a spring load of 0.40 N/mm, a free length of 14 mm and an inner diameter of 5 mm.

A genuine toner and developer, and a genuine photoreceptor unit of imagio Neo C455 were used. An AC component of a voltage applied to the charging roller was 1.5 kV between peaks and had a frequency of 0.9 kHz. A DC component had a bias such that the photoreceptor had a charged potential of −700 V from start to finish the running test. The developing bias was −500 V. The imagio Neo C455 did not have a discharger. The cleaner was replaced every time when 50,000 images were produced. The running test was performed at 24° C. and 54% RH. After the running test, a halftone pattern in which 2 dots×2 dots were drawn in 4×4 matrix at a pixel of 1,200 dpi×1,200 dpi was produced on a PPC paper TYPE-6200A4.

The evaluation results of image quality and surface roughness of respective Example 8 and Comparative Examples 4 to 7 are shown in the following Table 3.

TABLE 3

| | Image Quality | | Surface Roughness Rz(μm) | |
|---|---|---|---|---|
| | Before test | After test | Before test | After test |
| Example 8 | 5 | 4 | 0.5 | 0.7 |
| Comparative Example 4 | 4 | 2 | 0.6 | 1.8 |
| Comparative Example 5 | 5 | 2 | 0.4 | 1.9 |
| Comparative Example 6 | 4 | 2 | 0.7 | 1.4 |
| Comparative Example 7 | 5 | 2 | 0.7 | 1.5 |

The photoreceptor prepared in Example 8 produced quality images before and after the test, and the photoreceptor prepared in Comparative Examples 4 to 6 produced defective images due to damages on the photoreceptors. The photoreceptor prepared in Comparative Example 7 had no damage, but produced images having allover blank spots having the shape of rice-fish. The photoreceptors prepared in Comparative Examples 4, 6 and 7 did not include trimethylolpropanetriacrylate in the crosslinked surface layers. Namely, it is essential to include trimethylolpropanetriacrylate therein to strengthen the mechanical strength of a photoreceptor. The photoreceptor prepared in Comparative Examples 5 not including isocyanate including a radical polymerizable functional group and a heat curing monomer produced images having low image density after producing several images as the photoreceptor prepared in Comparative Examples 1, and had filming having the shape of rice-fish after the test. The isocyanate including a radical polymerizable functional group and a polyisocyanate component having a caprolactone framework are presumed to largely prevent filming.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2007-156188 filed on Jun. 13, 2007, the entire contents of which are herein incorporated by reference.

What is claimed is:

1. An electrophotographic photoreceptor, comprising:

an electroconductive substrate;

a photosensitive layer, located overlying the electroconductive substrate; and a crosslinked resin surface layer, located overlying the photosensitive layer, wherein the crosslinked resin surface layer comprises a crosslinked body comprising trimethylolpropanetriacrylate, isocyanate including a radical polymerizable functional group and a heat or a light-curable charge transport material, wherein the crosslinked resin surface layer comprises the heat or light-curable charge transport material having the following formula (4) in an amount not less than 5% and less than 60% by weight:

(4)

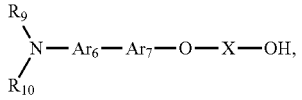

wherein $R_9$ and $R_{10}$ independently represent a substituted or an unsubstituted aryl group; $Ar_6$ and $Ar_7$ represent an arylene group, e.g., independently represent a bivalent group of the same aryl group as that of $R_9$ and $R_{10}$; and X represents any one of the following (a) to (c):

(a) an alkylene group;

(b) an arylene group;

(c) a group having the following formula (3); and (3)

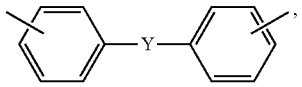

wherein Y represents —O—, —S—, —SO—, —$SO_2$—, —CO—,

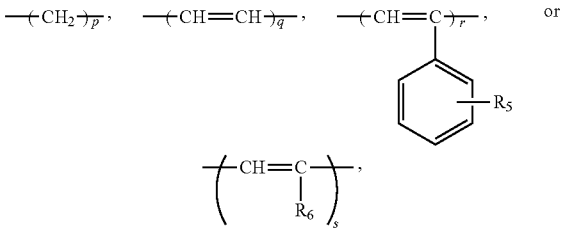

wherein $R_5$ and $R_6$ independently represent a hydrogen atom, an alkyl group, an alkoxy group, a halogen atom, an aryl group, an amino group, a nitro group or a cyano group; and p, q, r and s independently represent an integer of from 1 to 12.

2. The electrophotographic photoreceptor of claim 1, wherein the isocyanate including a radical polymerizable functional group is a member selected from the group consisting of 2-methacryloyloxyethylisocyanate, 2-acryloyloxyethylisocyanate and 1,1-bis (acryloyloxymethyl)ethylisocyanate.

3. A process cartridge, comprising the electrophotographic photoreceptor according to claim 1, and at least one of:

a charger configured to charge the electrophotographic photoreceptor;

an irradiator configured to irradiate the electrophotographic photoreceptor to form an electrostatic latent image thereon;

an image developer configured to develop the electrostatic latent image with a developer comprising a toner to form a toner image on the electrophotographic photoreceptor;

a transferer configured to transfer the toner image onto a receiving material;

a cleaner configured to remove the toner remaining on the electrophotographic photoreceptor; and a discharger configured to discharge the electrophotographic photoreceptor.

4. An image forming apparatus, comprising:

the electrophotographic photoreceptor according to claim 1;

a charger configured to charge the electrophotographic photoreceptor;

an irradiator configured to irradiate the electrophotographic photoreceptor to form an electrostatic latent image thereon;

an image developer configured to develop the electrostatic latent image with a developer comprising a toner to form a toner image on the electrophotographic photoreceptor;

a transferer configured to transfer the toner image onto a receiving material; and a fixer configured to fix the toner image on the receiving material.

5. The image forming apparatus of claim 4, wherein the crosslinked body of the crosslinked resin surface layer of the electrophotographic photoreceptor further comprises a polyol body having a caprolactone framework.

6. An electrophotographic photoreceptor, comprising:

an electroconductive substrate;

a photosensitive layer, located overlying the electroconductive substrate; and a crosslinked resin surface layer, located overlying the photosensitive layer, wherein the crosslinked resin surface layer comprises a crosslinked body comprising trimethylolpropanetriacrylate, isocyanate including a radical polymerizable functional group and a heat or a light-curable charge transport material, and wherein the crosslinked body further comprises a polyol body having a caprolactone framework.

7. An electrophotographic photoreceptor, comprising:

an electroconductive substrate;

a photosensitive layer, located overlying the electroconductive substrate; and a crosslinked resin surface layer, located overlying the photosensitive layer, wherein the crosslinked resin surface layer comprises a crosslinked body comprising trimethylolpropanetriacrylate, isocyanate including a radical polymerizable functional group and a heat or a light-curable charge transport material, wherein the crosslinked resin surface layer comprises the heat or light-curable charge transport material having the following formula (2) in an amount not less than 5% and less than 60% by weight:

(2)

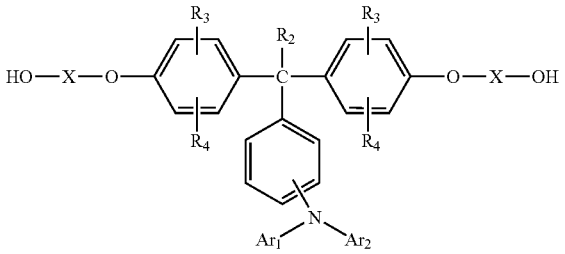

wherein $R_2$, $R_3$ and $R_4$ independently represent a hydrogen atom, a substituted or an unsubstituted alkyl group or an aryl group; $Ar_1$ and $Ar_2$ represent an aryl group; and X represents any one of the following (a) to (c):

(a) an alkylene group;

(b) an arylene group;

(c) a group having the following formula (3); and (3)

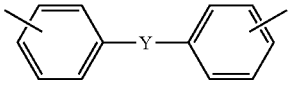

wherein Y represents —O—, —S—, —SO—, —$SO_2$—, —CO—,

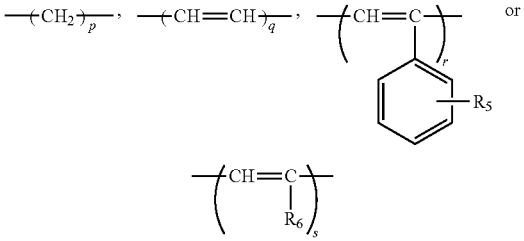

wherein $R_5$ and $R_6$ independently represent a hydrogen atom, an alkyl group, an alkoxy group, a halogen atom, an aryl group, an amino group, a nitro group or a cyano group; and p, q, r and s independently represent an integer of from 1 to 12.

* * * * *